US006036475A

United States Patent [19]

Matsui et al.

[11] Patent Number: 6,036,475

[45] Date of Patent: Mar. 14, 2000

[54] CYCLONIC TYPE COMBUSTION APPARATUS

[75] Inventors: Koichi Matsui; Isao Kuwagaki, both of Kyoto, Japan

[73] Assignee: Takuma Co. Ld., Osaka, Japan

[21] Appl. No.: 09/140,401

[22] Filed: Aug. 26, 1998

[30] Foreign Application Priority Data

Sep. 3, 1997 [JP] Japan ..... 9-238134

[51] Int. Cl.[7] ..... F23C 5/32

[52] U.S. Cl. ..... 431/173; 110/28; 122/29; 122/11

[58] Field of Search ..... 431/173; 110/28; 122/29

[56] References Cited

U.S. PATENT DOCUMENTS 707,216 8/1902 Duc ..... 431/173

5,209,187 5/1993 Khinkis ..... 431/173

*Primary Examiner*—Carroll Dority

*Attorney, Agent, or Firm*—Griffin, Butler, Whisenhunt & Szipl, LLP

[57] ABSTRACT

A cyclonic type combustion apparatus that may be constituted so as to jet out a premixed gas made up of a mixture of a gaseous fuel and air into a cylindrical combustion chamber, from nozzle ports provided on an inside cylinder wall, the combustion apparatus being especially adapted for heating the liquid medium in hot water heaters, smoke tube boilers, and the like. For instance, a premixed gas obtained by mixing a gaseous fuel with air is jetted out into a cylindrical combustion chamber from a nozzle port opened on its inner peripheral surface along the inner peripheral surface in its tangential direction. The combustion chamber is disposed in a storage region containing heating medium water. The peripheral wall of the combustion chamber is constituted to be a heat conductive wall which is in contact with the heating medium water. The flame formed by the premixed gas jetted out from the nozzle port is cooled by the heating medium water. This system enable combustion without the generation of unacceptable amounts of nitrogen oxides.

6 Claims, 17 Drawing Sheets

CYCLONIC TYPE COMBUSTION APPARATUS

FIELD OF THE INVENTION

This invention relates to a combustion apparatus. More particularly, the present invention relates to a cyclonic type combustion apparatus that may be constituted so as to jet out a premixed gas made up of a mixture of a gaseous fuel and air into a cylindrical combustion chamber, from nozzle ports provided on an inside cylinder wall. The combustion apparatus of the invention is especially adapted for heating the liquid medium in hot water heaters, smoke tube boilers, and the like.

BACKGROUND OF THE INVENTION

A variety of cyclonic combustion apparatuses of the general type described herein have been proposed in the past. Such apparatuses generate unacceptable amounts of nitrogen oxides ($NO_x$), especially thermal nitrogen oxides, during combustion. It is believed that such apparatuses have not, therefore, been put into actual use, at least in Japan.

The present invention is based upon a determination that the construction of the combustion chamber is an important factor in the failure of conventional cyclonic type combustion apparatuses to reduce nitrogen oxide generation. In prior art cyclonic type combustion apparatuses, the walls of the combustion chambers are generally made of refractory materials. In such apparatuses, the flame temperature rises, and they fail in practice to reduce nitrogen oxide generation very much.

SUMMARY OF THE INVENTION

The present invention has as an object the provision of a cyclonic type combustion apparatus that can substantially reduce the generation of nitrogen oxides and that is suitable for practical use.

The cyclonic type combustion apparatus according to the present invention has a cylindrical combustion chamber with nozzle ports open on the inside wall surface of the cylinder through which a premixed gas of a gaseous fuel and air for combustion are jetted out in the direction tangential to the inside circumference along the inner cylindrical surface of the combustion chamber.

To achieve the above-mentioned object of the invention, there is especially provided a storage region for the medium to be heated which surrounds the combustion chamber. At the same time, the cylinder wall which comes in contact with the medium to be heated is made heat conductive, so that the flame formed by the premised gas jetting from the nozzle ports may be cooled and brought to a low temperature by the medium to be heated.

Thus, the present invention provides a cyclonic combustion apparatus for heating a liquid. The apparatus comprises a cylindrical combustion chamber with at least one nozzle port open on an inside wall surface of said cylindrical combustion chamber, through which nozzle a premixed gas made by mixing a gaseous fuel and air for combustion are jetted out in a direction tangential to an inside circumference along an inner cylindrical surface of said cylindrical combustion chamber and a storage region for the liquid to be heated surrounding a peripheral wall of said cylindrical combustion chamber, wherein said peripheral wall is a heat-conductive wall that is in contact with the liquid to be heated so that the temperature of a flame formed by combustion of the premixed gas jetting out from the nozzle port is lowered by a conduction of heat through the peripheral wall into the liquid.

In one embodiment, the cylindrical combustion chamber is closed at an end part and open at another end part to form a combustion gas outlet, and is immersed in the liquid to be heated in said storage region with its axial line being horizontal. In another embodiment, the liquid is heating water and there is a flue from a combustion gas outlet passing between heat-conductive water pipes opened to the storage region, said flue being arranged so that combusted gas is discharged thereinto. In yet another embodiment, the liquid is boiler water and there is a flue from a combustion gas outlet passing along through fire tubes immersed in the storage region, said flue being arranged so that combusted gas is discharged thereinto.

The cyclonic combustion apparatus of the invention preferably comprises a plurality of nozzle ports. That plurality of nozzle ports may be arranged in a circumferential direction of the cylindrical combustion chamber, not shifted in the axial line direction thereof but taking the same position in the axial direction. In this case, the flame formed by combustion of the premixed gas jetting out from each nozzle port heating another nozzle port adjacent thereto in the direction in which the premixed gas is jetted out. Alternatively, that plurality of nozzle ports may be arranged in the vicinity of one another in a direction of the axial line of the cylindrical combustion chamber, not shifted but taking the same position in the circumferential direction thereof, the flame formed by combustion of the premixed gas jetting out from each nozzle port heating the nozzle port adjacent thereto.

DESCRIPTION OF PREFERRED EMBODIMENTS

Figure 1:
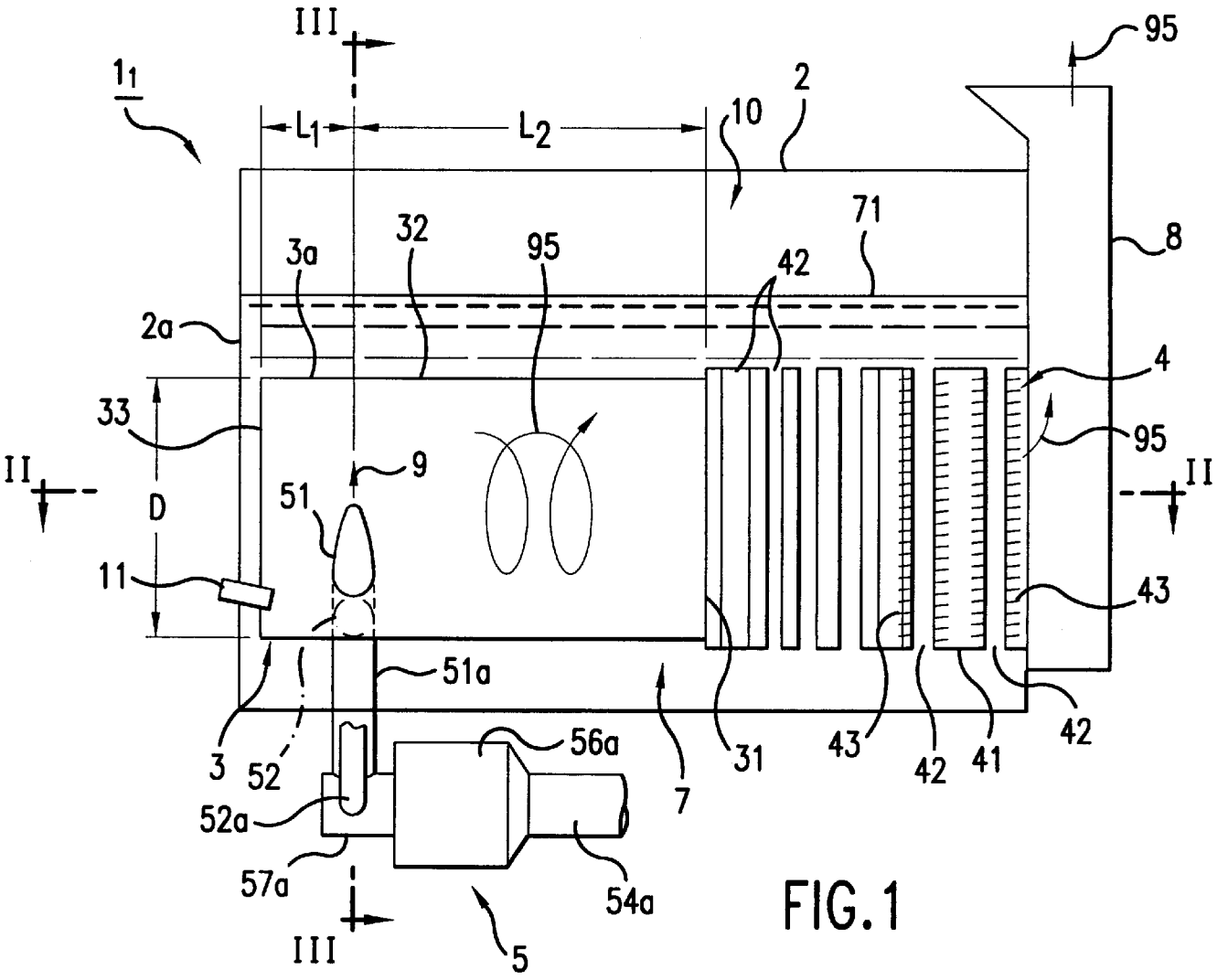
FIG. 1 is a vertical longitudinal section of a first combustion apparatus.

When used for a hot water heater, a smoke tube boiler, or the like, this cyclonic type combustion apparatus is so constituted that the combustion chamber is blocked at one end and opened at the other end as a combustion gas outlet, and is disposed immersed in the storage region for the medium to be heated with its axial line horizontal. When it is to be used in a hot water heater, for example, it is desired that the cyclonic type combustion apparatus is so arranged that, with the medium to be heated being heating medium water, the combustion gas is discharged to the flue after passing from the combustion gas outlet through gaps between the heat conductive water pipes open to the storage region for heating medium water. When it is used for a smoke tube boiler, it is desirable that the cyclonic type combustion apparatus is so constituted that with the medium to be heated being boiler water, the combustion gas is discharged to the flue after passing from the combustion gas outlet through smoke tubes disposed immersed in the storage region for heating medium water.

Such a cyclonic type combustion apparatus can be so designed that a plurality of nozzle ports, to jet out the premixed gas in the direction tangential to the inside circumference of the combustion chamber along the inside wall surface thereof, are open on the inner cylindrical surface. In that case, it is desirable that the number of nozzles and their positions should be set as follows. A plurality of nozzle ports, for example, are arranged in the circumferential direction of the combustion chamber, and are not shifted in the direction of the axial line of the combustion chamber but take the same position in the axial direction. In this case, it is preferably so arranged that the flame burning the premixed gas jetting out of each nozzle port heats the nozzle adjacent thereto in the direction of squirting of the premixed gas jetting out of the nozzle port. It is also possible to arrange a plurality of nozzle ports in the direction of the axial line of the combustion chamber, all taking the same position in the circumferential direction of the combustion chamber. In this case, it is desirable to narrow the interval between ports in the direction of the axial line of the combustion chamber as much as possible so that each nozzle port is heated by the flame from the nozzle port adjacent thereto in the direction of axial line of the combustion chamber. It is also possible to divide a plurality of nozzle ports into a plurality of groups of nozzle ports, the nozzle ports in each group arranged side by side in the direction of the axial direction of the combustion chamber, all taking the same position in the circumferential direction of the combustion chamber and those groups disposed in such a way that the groups are shifted from each other in position both in the circumferential direction and the axial line direction of the combustion chamber.

EXAMPLES

In the Examples which follow, preferred embodiments of the present invention will be described in detail with reference to FIGS. 1 through 18. As will be apparent from the context, the terms "front", "before", "forth", and "forward", where used in the following descriptions, may denote "right", "to the right", or "relating to the right", and the terms "rear", "behind", "back", and "backward" may mean "left", "to the left", or "relating to the left".

Example 1—Hot Water Heater

FIGS. 1–8 show an embodiment of the present invention. The cyclonic type combustion apparatus $\mathbf{1}_1$, according to the first embodiment of the present invention, hereinafter referred to as first combustion apparatus, is incorporated into a hot water heater comprising a main casing 2, a furnace or a combustion chamber 3, a heat exchanger 4, a premixed gas feeder 5, and in igniter 6.

Figure 2:
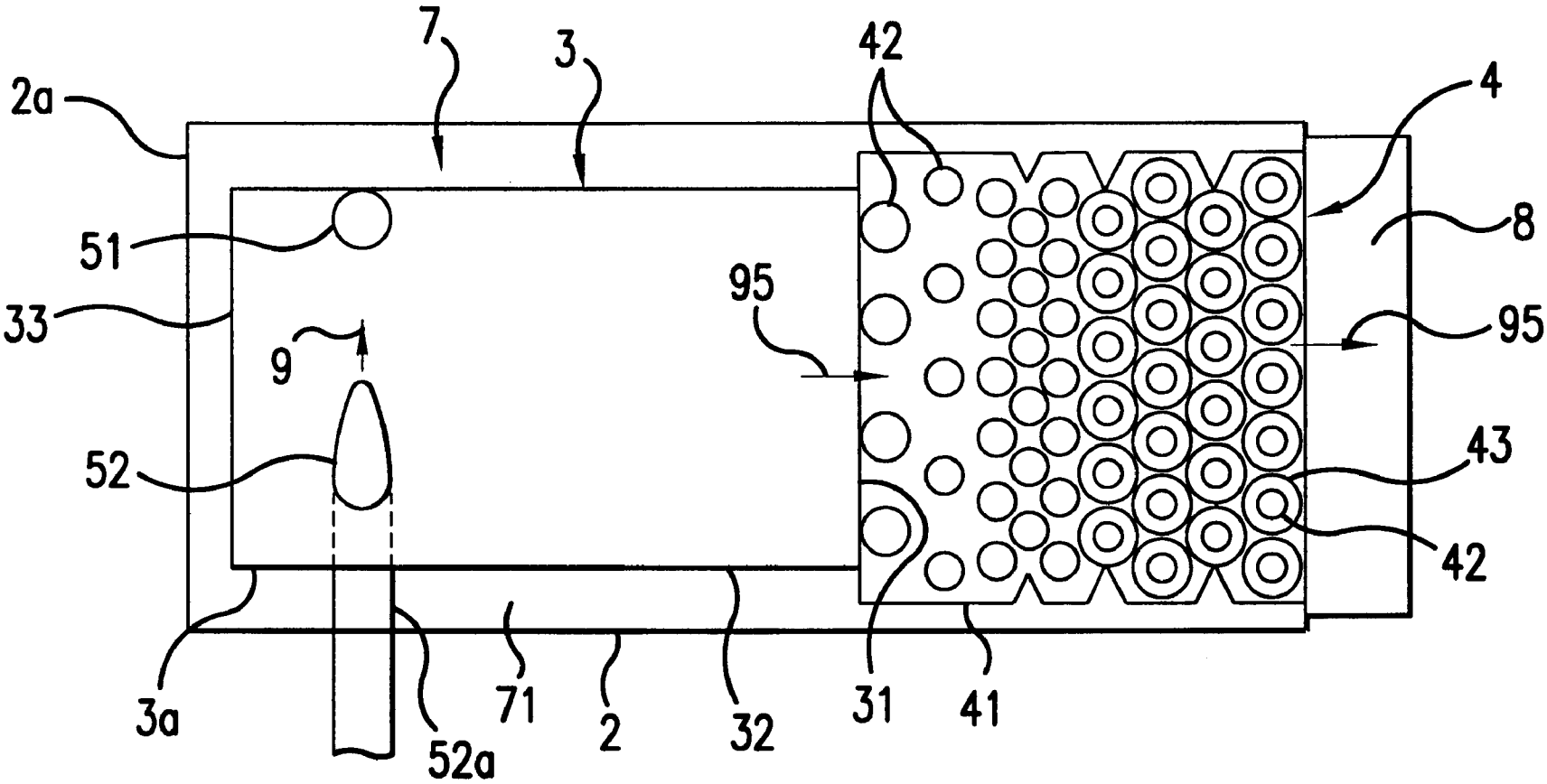
FIG. 2 is a horizontal sectional plan view of the first combustion apparatus, taken on line II—II of FIG. 1.
Figure 3:
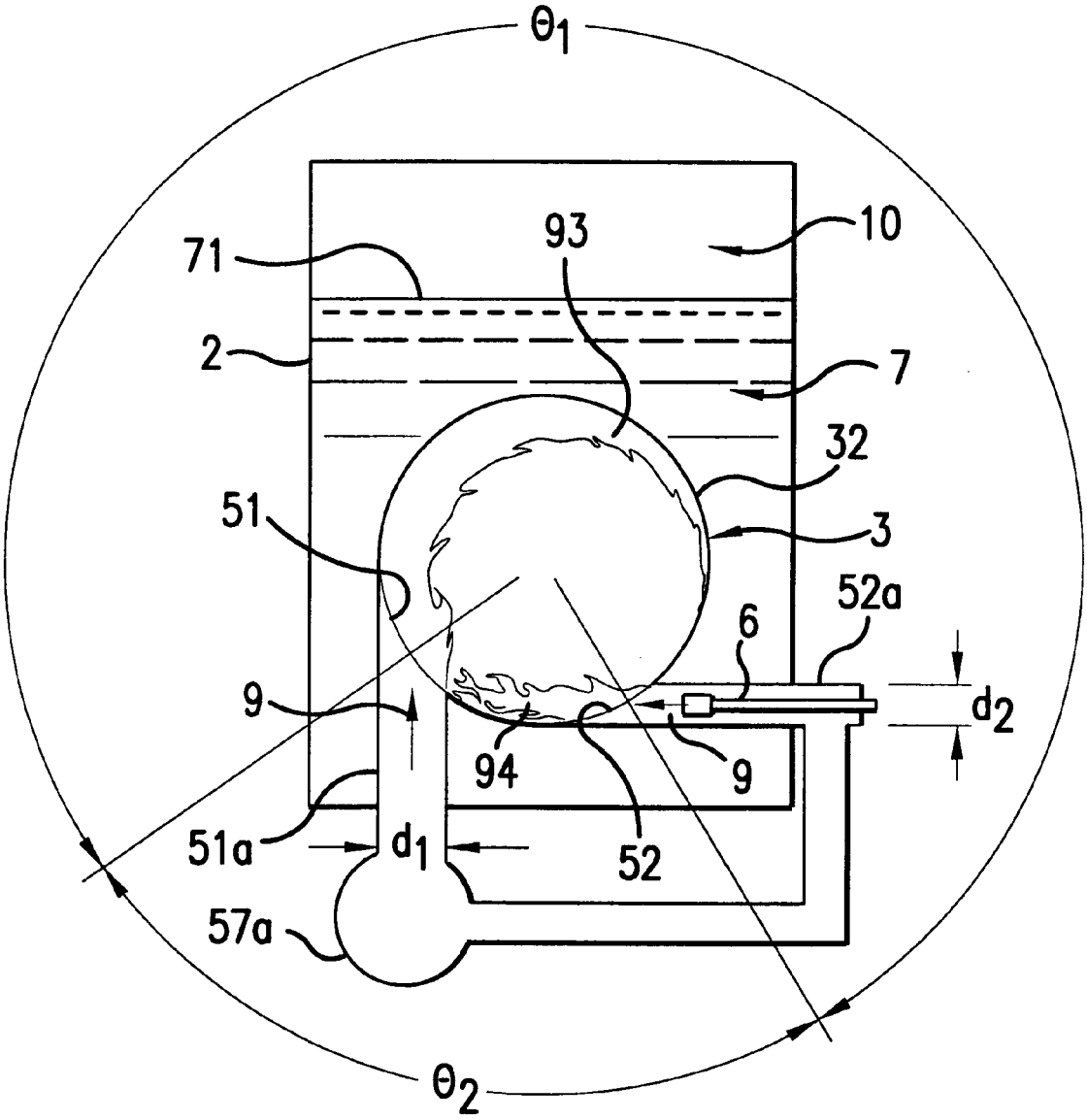
FIG. 3 is a cross-sectional side view of the first combustion apparatus, taken on line III—III of FIG. 1.

The main casing 2 is in the shape of a rectangular box of metal wall construction, as shown in FIGS. 1–3, and stores a specific quantity of the medium to be heated, or heating medium water 71. The upper space in the storage region 7 for the heating medium water 71 is a reduced pressure region 10 brought to a specific pressure. This reduced pressure region 10 is provided with a warm water circulation channel (not shown) connected to a hot water supply, heating, or the like, system.

The combustion chamber 3 is of furnace cylinder construction with the rear end being a combustion gas outlet 31, and comprises a cylindrical peripheral wall or cylinder wall 32 and a circular end wall 33 closing the front end, both made of metal plate. The combustion chamber 3 is immersed in the storage region 7 for the heating medium water with the axial line being horizontal and with the end wall 33 kept at a specific distance from the front wall 2*a* of the main casing 2 as shown in FIGS. 1–3. That is, the cylinder wall 32 and the end wall 33 both are heat conductor walls, which come into contact with the medium to be heated, or a heating medium water 71, and are cooled in a heat exchange with the heating medium water 71. The inside cylindrical surface or the inside surface of the cylinder wall 32 of the combustion chamber 3 are provided with a plurality of nozzle ports 51, 52 at the front end section 3*a*. These nozzle ports jet out a premixed gas 9 in the direction tangential to the circumference thereof along the inside cylindrical surface of the cylinder wall. The nozzle ports are arranged in the circumferential direction of the combustion chamber, not shifted but taking the same position in the axial direction of the combustion chamber (identical in position in the axial direction of the combustion chamber) as described later. The end wall 33 is mounted to the front wall 2*a* of the main casing 2 by means of suitable stays (not shown). As a safety measure, the end wall 33 is provided with a flame detector 11 which checks the condition of flames from the nozzle ports 51, 52 and flames of the pilot burner 6 which will be described later. The flame detector 11 is mounted in the inward direction on the combustion chamber 3 in an inclined or downward position to prevent the formation of dew drop water.

As shown in FIGS. 1 and 2, the heat exchanger 4, positioned in the rear portion of the combustion chamber 3, is placed immersed in the storage region for the heating medium water. The heat exchanger comprises a box-shaped peripheral wall 41 and a group of heat-conductive water tubes 42 supported by the upper and lower ends of the wall 41 and penetrating therethrough. The respective water tubes 42 extend upward and downward with both ends open to the storage region 7. The group of water tubes 42 are disposed zigzag as shown in FIG. 2 and, as is known, designed so that the distance (pitch) between tubes decreases as the tubes are located farther from the combustion gas outlet 31 and approach the rear end. The water tubes 42 on the rear side are provided with fins 43 in a suitable shape. The rear end of the heat exchanger 4 is connected communicated with the flue 8 formed of metal plate. The combustion gas 95 generated in the combustion chamber 3 is discharged into the flue 8 after passing through the combustion gas outlet 31 and the gaps formed by the group of water tubes 42. The heating medium water 71 in the respective water tubes 42 is heated by a heat exchange with the combustion gas 92 and is subjected to natural circulation.

The premixed gas feeder 5 supplies the premixed gas 9 to the premixed gas combustion section, or the combustion chamber, 3. The premixed gas is formed of a mixture of the gaseous fuel 91, for instance natural gas, and air 92, for combustion as shown in FIGS. 1–8. This premixed gas feeder 5 comprises an air flow separating mechanism 54 for separating the combustion air 92 into two portions of air with a specific flow rate for formation of a premixed gas 9, that is, the first portion of combustion air 92*a* and the second portion of combustion air 92*b*. Additionally, the gas feeder comprises a primary mixing mechanism 55 to mix the first portion of combustion air 92*a* and the gaseous fuel 91 with a specific flow rate to form premixed gas 9. The gas feeder also comprises a secondary mixing mechanism 56 for mixing the primary mixed gas $\mathbf{9}_1$ produced in the primary mixing mechanism 55 and the second portion of combustion air 92*b* which has passed through the air flow separating mechanism 54. The gas feeder comprises too a premixed gas producing mechanism 57 for further mixing and stirring a secondary mixed gas $\mathbf{9}_2$ produced in the secondary mixing mechanism 56 by imparting a swirling force. Finally, the gas feeder comprises a premixed gas feeding mechanism to feed the premixed gas 9 produced in the premixed gas producing mechanism to the premixed gas combustion section, or the combustion chamber, 3.

The premixed gas feeding mechanism comprises a main nozzle 51*a* with a nozzle port 51 and an auxiliary nozzle 52*a* with a nozzle port 52 open on the inside cylindrical surface of the combustion chamber 3. Both nozzles 51*a* and 52*a* are provided on the cylinder wall 32 of the combustion chamber 3 at a specific distance $L_1$ from the end wall 33 at different positions in the direction of circumference of the combustion chamber 3. The nozzles are provided so that the premixed gas 9 is jetted out of the nozzle ports 51, 52 in the direction tangential to the inside cylindrical surface of the combustion chamber 3 and that the jetting directions are identical in relation to the circumferential direction of the combustion chamber 3, as shown in FIGS. 1–4. The respective nozzles 51*a*, 52*a* are fabricated of a metal pipe which has a cross-sectional shape that ensures smooth flow of the premixed gas 9 with no partial slowdown or stagnation, thus effectively preventing backfire. In the present embodiment, a round cross-section is adopted. As the premixed gas 9 being jetted out of nozzles 51*a*, 52*a* is ignited, flames 93, 94 are formed along the inside cylindrical surface of combustion chamber 3. As described later, the inside diameter $d_1$ of the main nozzle 51*a* is larger than the inside diameter $d_2$ of the auxiliary nozzle 52*a*. That is, diameter $d_1$>diameter $d_2$ so that the flame 93 of the gas 9 jetted out of the main nozzle port 51 is longer than the flame 94 of the gas 9 jetted out of the auxiliary nozzle port 52. It is desirable that the inside diameter $d_1$ of the main nozzle 51*a* be set according to the inside diameter D of the combustion chamber. Experiments show that the ratio $D/d_1$ is preferably greater than 4.5, if a satisfactory cyclonic combustion, which will be described later, is to be achieved. It is also configured so that the interval between the two nozzle ports 51 and 52 as measured in the direction of gas jetting out of the auxiliary nozzle port 52—or the central angle $\theta_2$ formed by the two ports spaced in the circumferential direction of the combustion chamber 3—is made smaller by a specific amount than the interval between the two nozzle ports 51 and 52 as measured in the direction of gas jetting out of the main nozzle port 51—or the central angle $\theta_1$ formed by the two ports spaced in the circumferential direction of the combustion chamber 3. That is, $\theta_1>\theta_2$ so that the flame from the auxiliary nozzle port 52 directly heats the main nozzle port 51. Furthermore, it is more desirable that the ratio of the two distances $\theta_1$ and $\theta_2$ is made roughly identical with the ratio of lengths of the flames 93 and 94 so that part of the flame 93 from the main nozzle port 51 also directly heats the auxiliary port 52 on condition that the flame 94 directly heats the main nozzle port 51. It is also preferable that the distance $L_1$ between the nozzle ports 51, 52 and the end plate 33 in the front-rear direction (in the axial direction of the combustion chamber) should be set according to the diameters of the nozzles, especially the diameter $d_1$ of the main nozzle 51*a* which jets out a larger amount of gas, so that the combustion gas may recirculate in the area between the nozzles 51, 52 and the end plate 33. Experiments show that preferably $L_1>d_1>d_2$. It is also desirable that the distance $L_2$ between the nozzle ports 51, 52 and the combustion gas outlet 31 in the front-rear direction (in the axial direction of the combustion chamber) should be set according to the diameter D of the combustion chamber so that a cyclonic combustion which will be described later may take place. Experiments indicate that preferably $L_2>1.5D$. Experiments also show that if the cyclonic combustion is to proceed satisfactorily, it is preferable that the velocity of gas jetting out of the nozzles 51, 52 should be set at not lower than 15 m/sec.

The air flow separating mechanism 54 is provided with an air flow separating cylinder 54*b* concentrically within a combustion air feed tube 54*a* with a round cross-section at the downstream end area thereof which feeds a specific flow rate of combustion air 92 to form the premixed gas 9. In this mechanism, the combustion air 92 which has reached the downstream end area of the combustion air feed tube 54*a* is separated into two portions. The first portion of combustion air 92*a* flows into the inside of the air flow separating cylinder 54*b*. The second portion of combustion air 92*b* flows along the outside circumferential area. The air flow separating cylinder 54*b* is supported and mounted on the inside cylindrical surface of the combustion air feed tube 54*a* by means of stays (not shown) which do not hinder the flow of the second portion of combustion air 92*b*.

Figure 6:
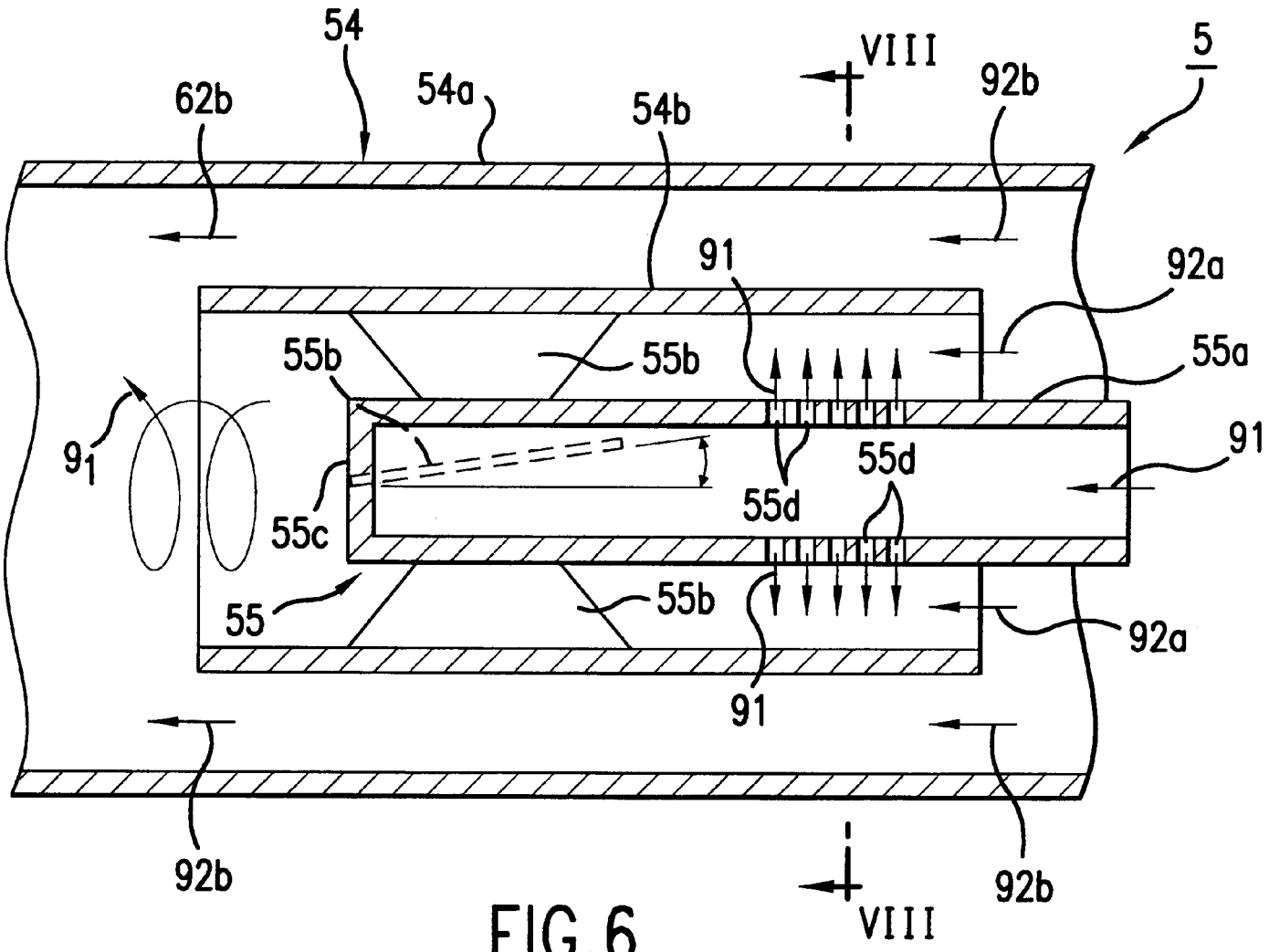
FIG. 6 is an enlarged detail of another part of the main component of FIG. 4.
Figure 8:
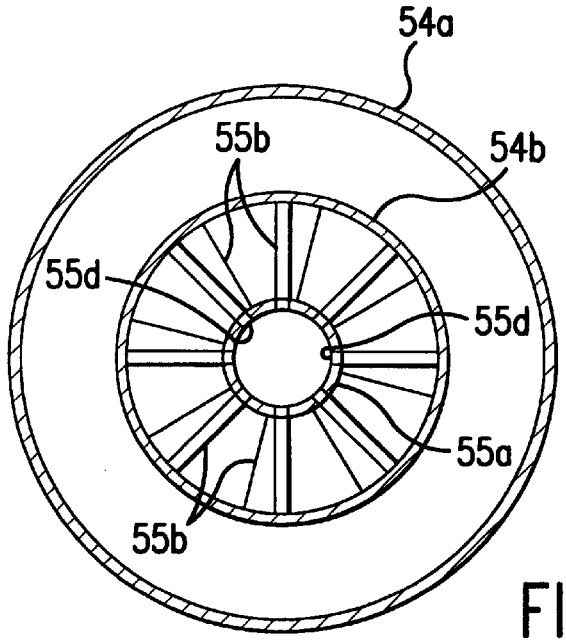
FIG. 8 is a cross-sectional view, taken on line VIII—VIII of FIG. 6.

The primary mixing mechanism 55 comprises a gaseous fuel feed tube 55*a* with a round cross-section which feeds a specific flow rate of gaseous fuel 91 to form the premixed gas 9 and a plurality of swirling vanes 55*b* . . . mounted radially at th e forward end portion of the tube at the same interval in the circumferential direction. The tip of the gaseous fuel feed tube 55*a* or the front end portion is inserted in the air flow separating cylinder 54*b* through the wall of the combustion air feed tube 54*a* and concentrically mounted on the inside cylindrical surface of the air flow separation cylinder 54*b* by means of the swirling vanes 55*b* . . . The gaseous fuel feed tube 55*a* is closed at the front end 55*c* and provided with a plurality of blowout holes 55*d* . . . around the tube wall in a portion behind the swirling vanes 55*b* . . . so that the gaseous fuel 91 may blow out radially toward the inside cylindrical surface of the air flow separating cylinder 54*b*. The swirling vanes 55*b* . . . may be trapezoidal in shape and are mounted but inclined by a certain angle $\alpha$ with respect to the axial line as shown in FIGS. 6 and 8. In the primary mixing mechanism 55, therefore, the first portion of combustion air 92*a* and the gaseous fuel 91 blown out of the blowout hole 55*d* in the gaseous fuel feed tube 55*a* are mixed in the air flow separating cylinder 54*b* and given a swirling force by the swirling vanes 55*b* . . . for further mixing and stirring to produce a mixed gas of the fuel 91 and the first portion of combustion air 92*a*, that is a primary mixed gas $9_1$. This primary mixed gas $9_1$ flows out of the front end section of the air flow separating cylinder 54*b* in a swirling current.

The secondary mixing mechanism 56 comprises a secondary mixing cylinder 56*a* with a round cross-section concentrically connected to the front end of the combustion air feed tube 54*a*, a secondary mixing passage 56*b* formed within the secondary mixing cylinder 56*a*, and a plurality of current plates 55*b* . . . provided in the downstream end portion of the secondary mixing passage 56*b*, as shown in FIGS. 4–7. The secondary mixing cylinder 5*a*, which is larger than the combustion air feed tube 54*a* in diameter, has a truncated cone-shaped rear end portion tapering toward the rear end which is connected to the front end of the combustion air feed tube 54*a*. The secondary mixing passage 56*b* is formed by an inner cylinder 56*d* with a round cross-section provided concentrically within the secondary mixing cylinder 56*a* and a blocking plate 56*e* closing between the rear end section of the premixed gas producing cylinder 57*a* with a round cross-section (which will be described later) and the front end of the secondary mixing cylinder 56*a* and another blocking plate 56*f* closing the rear end of the inner cylinder 56*d*. Thus, concentric cylindrical passage portions 56'*b*, 56"*b* formed between the inside and outside circumferential surfaces of those cylinders 56*a*, 56*d*, 57*a* communicate with each other in a zigzag fashion. In the secondary mixing passage 56*b*, the primary mixed gas $9_1$ flowing out of the front end portion of the air flow separating cylinder 54*b* in a swirling current joins the second portion of combustion air 92*b* passing through the outside circumferential area of the air flow separating cylinder 54*b*, flowing zigzag, to produce a secondary mixed gas $9_2$ or a mixture of the primary mixed gas $9_1$ and the second portion of combustion air 92*b*. In other words, the primary mixed gas $9_1$ and the second portion of combustion air 92*b* move forward through the first cylindrical passage portion 56'*b* formed between the secondary mixing cylinder 56*a* and the inner cylinder 56*d*. Colliding against the blocking plate 56*e*, the gas and the air swirl and flow backward along the second cylindrical passage portion 56"*b* formed between the inner cylinder 56*d* and the premixed gas producing cylinder 57*a*, then hit the blocking plate 56*f* of the inner cylinder 56*d* then again change direction and proceed to the rear end portion of the premixed gas producing cylinder 57*a*. During that process, the gas and the air are mixed. Current plates 56*c* are provided between the inside cylindrical surface of the inner cylinder 56*d* and the outer circumferential surface of the premixed gas producing cylinder 57*a* and are mounted radially in the direction parallel with the axial line and at the same interval in the circumferential direction. The current plates regulate the current of the secondary mixed gas 92 as it passes through the second cylindrical passage portion 56" so that the gas flows into the upstream end portion of the premixed gas producing cylinder 57*a* evenly from around the rim of the cylinder rear end.

Figure 4:
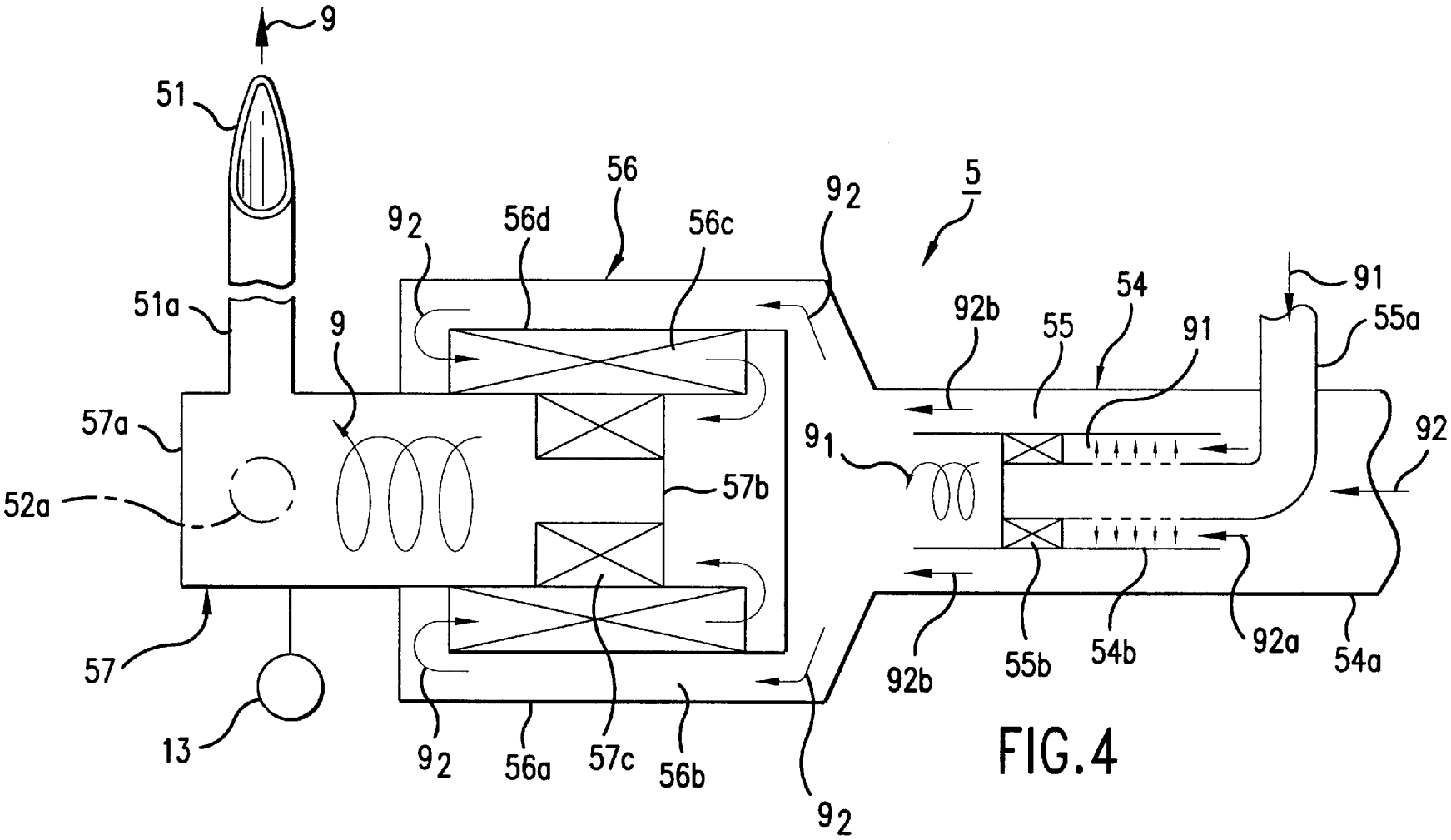
FIG. 4 is a vertical longitudinal sectional view of a main component (premixed gas feeder) of the first combustion apparatus.
Figure 5:
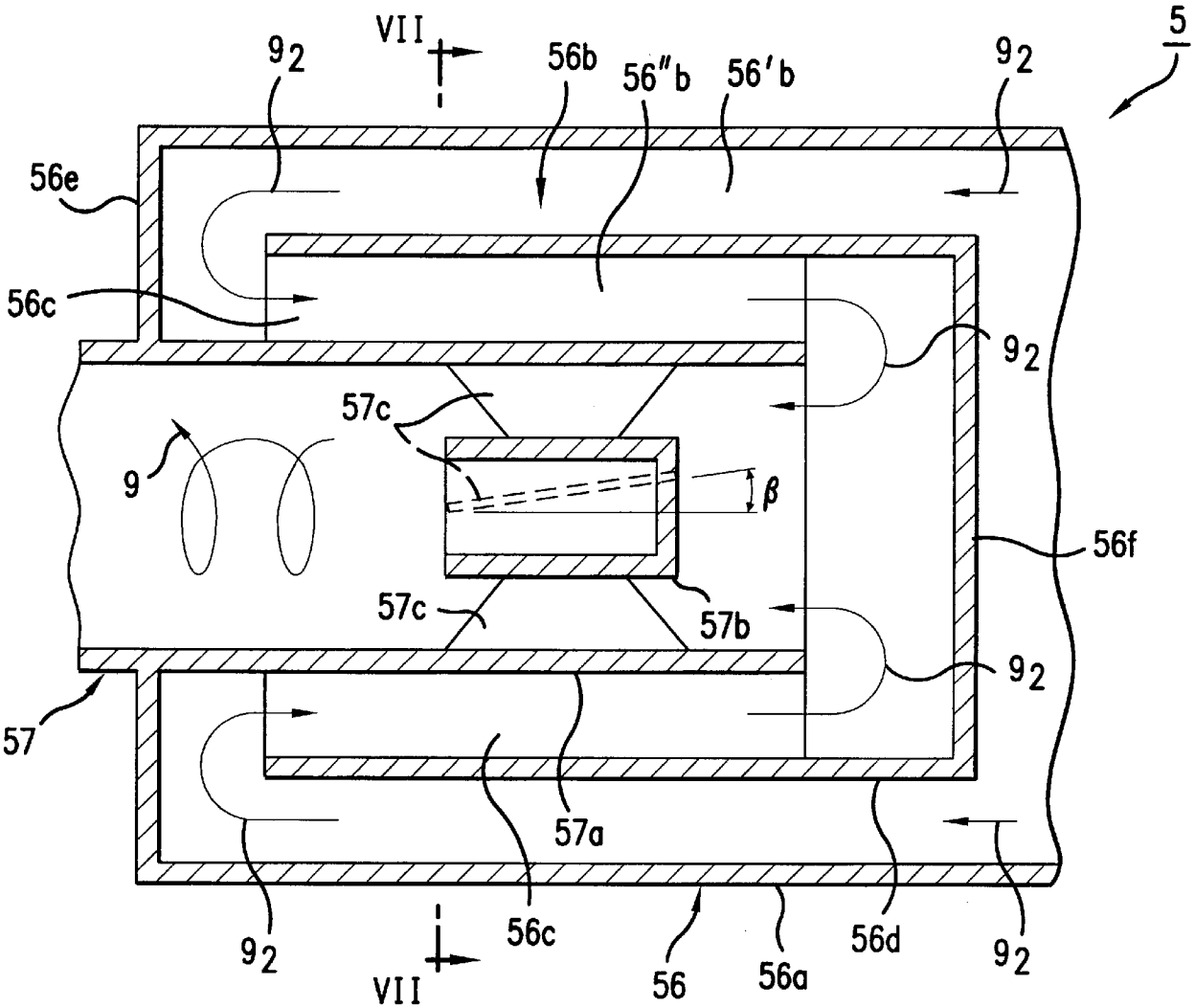
FIG. 5 is an enlarged detail of a part of the main component of FIG. 4.
Figure 7:
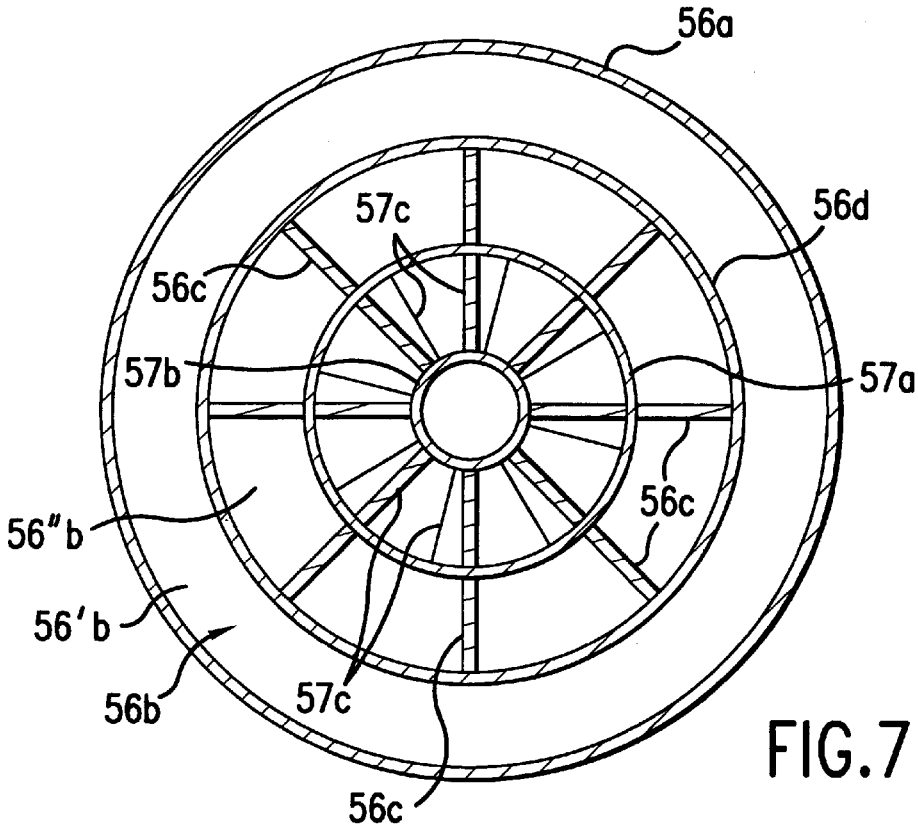
FIG. 7 is a cross-sectional view, taken on line VII—VII of FIG. 5.

The premixed gas producing mechanism 57 comprises the premixed gas producing cylinder 57*a* with a round cross-section to which the main nozzle 51*a* and the auxiliary nozzle 52*a* are connected and a plurality of swirling vanes 57*c* . . . disposed within the premixed gas producing cylinder 57*a*, as shown in FIGS. 4, 5, and 7. The premixed gas producing cylinder 57*a* has its rear end portion intruding into the inner cylinder 56*d* concentrically through the blocking plate 56*e* of the secondary mixing cylinder 56*a*. The premixed gas producing cylinder 57*a* has a bottomed cylinder 57*b* with a closed rear end mounted concentrically within the rear end portion, with a plurality of swirling vanes 57c... provided between the inside cylindrical surface of the cylinder 57*a* and the outer circumferential surface of the cylinder 57*b* radially and at the same interval in the circumferential direction. The swirling vanes 57*c* . . . may be trapezoidal in shape and are mounted at a proper inclined angle β with respect to the axial line of the cylinders 57*a*, 57*b*. The front end portion of the premixed gas producing cylinder 57*a* protrudes forward through the secondary mixing cylinder 56*a*, with its cylinder wall connected and communicated with the main nozzle 51*a* and the auxiliary nozzle 52*a*. The front end of the premixed gas producing cylinder 57*a* is closed. As it flows into the rear end portion of the premixed gas producing cylinder 57*a*, after passing through the second cylindrical passage portion 56", where the current plates 56*c* . . . are provided, the secondary mixed gas $9_2$ is given a swirling force by the swirling vanes 57*c* . . . , mixed, and stirred in the premixed gas producing mechanism 57. Thus, there is produced a premixed gas 9 in which the gaseous fuel 91 and the combustion air 92 are mixed homogeneously. In that process, the secondary mixed gas $9_2$ is regulated by the current plates 57*c* . . . ,flowing into the premixed gas producing cylinder 57*a* evenly in the circumferential direction. That ensures the imparting of swirling force by the swirling vanes 57*c* . . . and mixing and stirring of the secondary mixed gas $9_2$ by the swirling in a more even and effective manner. The premixed gas 9 thus obtained flows forward in a swirl current from the swirling vanes 57*c* and jets out of the respective nozzles 51*a*, 52*a* into the combustion chamber 3. The premixed gas producing cylinder 57*a* is provided with a pressure detector 13 which checks whether a proper level of pressure to supply a necessary amount of the premixed gas to secure a specific quantity of combustion is maintained in the combustion chamber 3. It is so designed that if the pressure drops below the proper level, combustion will be suspended as a precaution.

Meanwhile, the extent of swirling force imparted by swirling vanes 55*b*, 57*c* is determined by the angles of inclination α, β of the swirling vanes 55*b*, 57*c*. Experiments show that if the angles of inclination α, β are less than 10 degrees, a swirling force sufficient to mix and stir the gaseous fuel 91 and the combustion air 92 well will not be generated, because of a great difference in specific gravity between the gaseous fuel and the air. Angles of inclination α, β greater than 20 degrees could cause too much stirring by swirling and separate the mixture back into gaseous fuel and air. For this reason, the angles of inclination α, β of the swirling vanes are preferably between 10 and 20 degrees. In the present example, the angles are set at 15 degrees. The number of swirling vanes 55*b*, 57*c* are also a factor determining the swirling force. Too many swirling vanes are not desirable because that could result in loss of pressure. In the present example, 8 are used.

The igniter 6 is a pilot burner mounted near the nozzle port 52 inside the auxiliary nozzle 52*a*, as shown in FIG. 3. The flame of the pilot burner 6 ignites the premixed gas 9 jetted out of the respective nozzle ports 51, 52. Once the premixed gas 9 is ignited, the pilot burner 6 is extinguished. It is also arranged so that before pilot burner 6 is lighted, premixed gas feeder 5, combustion chamber 3, and heat exchanger 4 are purged.

With this first combustion apparatus $1_1$ thus constituted, a so called cyclonic combustion takes place in combustion chamber 3, with a low nitrogen oxide combustion achieved.

First premixed gas feeder 5, combustion chamber 3, and heater exchanger 4 are purged as mentioned, and premixed gas 9 is jetted out of the respective nozzles 51, 52. In this step, the respective nozzles 51*a*, 52*a* are supplied with a homogeneously premixed gas 9 of gaseous fuel 91 and combustion air 92 with a very high degree of mixing from premixed gas feeder 5.

To further illustrate, the combustion air 92 supplied from the combustion air feed tube 54*a* is separated into two portions of air: the first portion of combustion air 92*a* which flows into the air flow separating cylinder 54*b* and the second portion of combustion air 92*b* which passes outside the air flow separating cylinder 54*b*. In air flow separating cylinder 54*b*, the gaseous fuel 91 is blown out of the blowout holes 54 . . . provided on the gaseous fuel feed tube 55*a* radially in the directions perpendicular to the flowing direction of the first portion of combustion air 92*a*, where the fuel gas 91 and the first portion of combustion air 92*a* are mixed. Further, the mixed gas of the fuel gas 91 and the first portion of combustion air 92*a*, or the primary mixed gas flows out from the front end of the air flow separating cylinder 54*b* after passing through the swirling vanes 55*b*. In that stage, the swirling vanes 55*b* . . . mounted at an angle of inclination $\alpha$ as mentioned gives the primary mixed gas $9_1$ a swirling force to the extent that the constituent gas 91 and the first portion of combustion air 92*a* will not be separated, that is, a weak swirling force. Thus, the mixing degree of the primary mixed gas $9_1$ is further increased. The primary mixed gas $9_1$ flowing out from the front end of the air flow separating cylinder 54*b* proceeds to the secondary mixing cylinder 56*a* together with the second portion of combustion air 92*b* that has passed along the outer circumferential surface of the air flow separating cylinder 54*b*, and then flows through the zigzag secondary mixing passage 56*b* formed within the secondary mixing cylinder 56*a*, making turns. In the meantime, the primary mixed gas $9_1$ flowing out of the air flow separating cylinder 54*b* is given a swirling force by the swirling vanes 55*b* . . . Therefore, the primary mixed gas $9_1$ and the second portion of combustion air 92*b* are well mixed to produce a secondary mixed gas $9_2$ at the starting point of the secondary mixing passage 56*b*, which has the same composition as the desired remixed gas 9. Incidentally, there is much difference in specific gravity between the gaseous fuel 91 and the combustion air 92. Therefore, the degree of mixing, with the secondary mixed gas $9_2$ obtained when the primary mixed gas $9_1$ obtained from a mixture between the first portion 92*a* of the combustion air 92 and the gaseous fuel 91 is additionally mixed with the rest 92*b* of the combustion air, is higher than that obtained by mixing the gaseous fuel 91 with all of the combustion air 92 at once.

The secondary mixed gas $9_2$ flows through the meandering secondary mixing passage 56*b*, making turns, and is mixed homogeneously by a stirring effect produced in making turns. While it is short in length in the axial direction (lengthwise distance), the secondary mixing passage 56*b* is meandering and the flowing distance of the secondary mixed gas $9_2$ in the secondary mixing passage 56*b* is sufficiently long. While passing through the secondary mixing passage 56*b*, the degree of mixing of the secondary mixed gas $9_2$ is increased further. In other words, the meandering construction of the secondary passage 56*b* can reduce the size of the premixed gas feeder 5, while increasing the degree of mixing of the gaseous fuel 91 and the combustion air 92.

Then, the secondary mixed gas $9_2$ flows from the secondary mixing passage 56*b* into the premixed gas producing cylinder 57*a*, where the gas is given a swirling force by the swirling vanes 57*c* . . . Thus, the mixing degree of premixed gas 9 is adjusted one last time by the stirring effect of the swirl. In this stage, while passing through the current plates 56*c* . . . provided in the downstream section of the secondary mixing passage 56*b* (second cylindrical passage portion 56"), the secondary mixed gas $9_2$ corrects the turbulence caused by the reversal of flow. Then, the gas is led into the premixed gas producing cylinder 57*a* evenly from the entire rear end edge of the cylinder. Therefore, no unevenness in the swirling force to be imparted to the secondary mixed gas $9_2$ is caused by the swirling vanes 57*c* . . . Thus, the secondary mixed gas $9_2$ receives uniform swirling. As a result, the premixed gas 9 flowing out of the swirling vanes 57*c* is very high in degree of mixing. Since the swirling vanes 57*c* . . . are positioned at an angle of inclination $\beta$ as mentioned above, the premixed gas 9 obtained is high in degree of mixing, and free from such potential problems caused by imparting a swirling force as separation of the gaseous fuel 91 and the combustion air 92 caused by their difference in specific gravities.

The premixed gas 9 thus obtained is supplied to the respective nozzles 51*a*, 52*a* from the premixed gas producing cylinder 57*a*, and jetted out into the combustion chamber 3 from the nozzle ports 51, 52. Since it is given a swirling force in premixed gas producing cylinder 57*a*, premixed gas 9 is supplied to the -respective nozzles 51*a*, 52*a* with the mixing degree maintained. Thus, a premixed gas 9 with a very high degree of mixing is jetted out of the nozzles 51, 52.

As the premixed gas 9 is fed to the combustion chamber 3 as set forth above, the pilot burner 6 ignites the premixed gas 9 jetted out of the respective nozzles 51, 52, starting a cyclonic combustion. That is to say, the premixed gas 9 is jetted out in the direction tangential to the inside cylindrical surface, forming arc-formed flames 93, 94 along the inside cylindrical surface of the combustion chamber 3 of the inside cylindrical surface of cylinder wall 32, extending in contact with the inside cylindrical surface, as shown in FIG. 3.

Since the cylinder wall 32 of the combustion chamber 3 is a heat conductive wall in contact with the heating medium water 71, flames 93, 94 are cooled by the heating medium water 71. Because flames 93, 94 are cooled and brought to a reduced temperature, thermal generation of nitrogen oxides is minimized.

Figure 10:
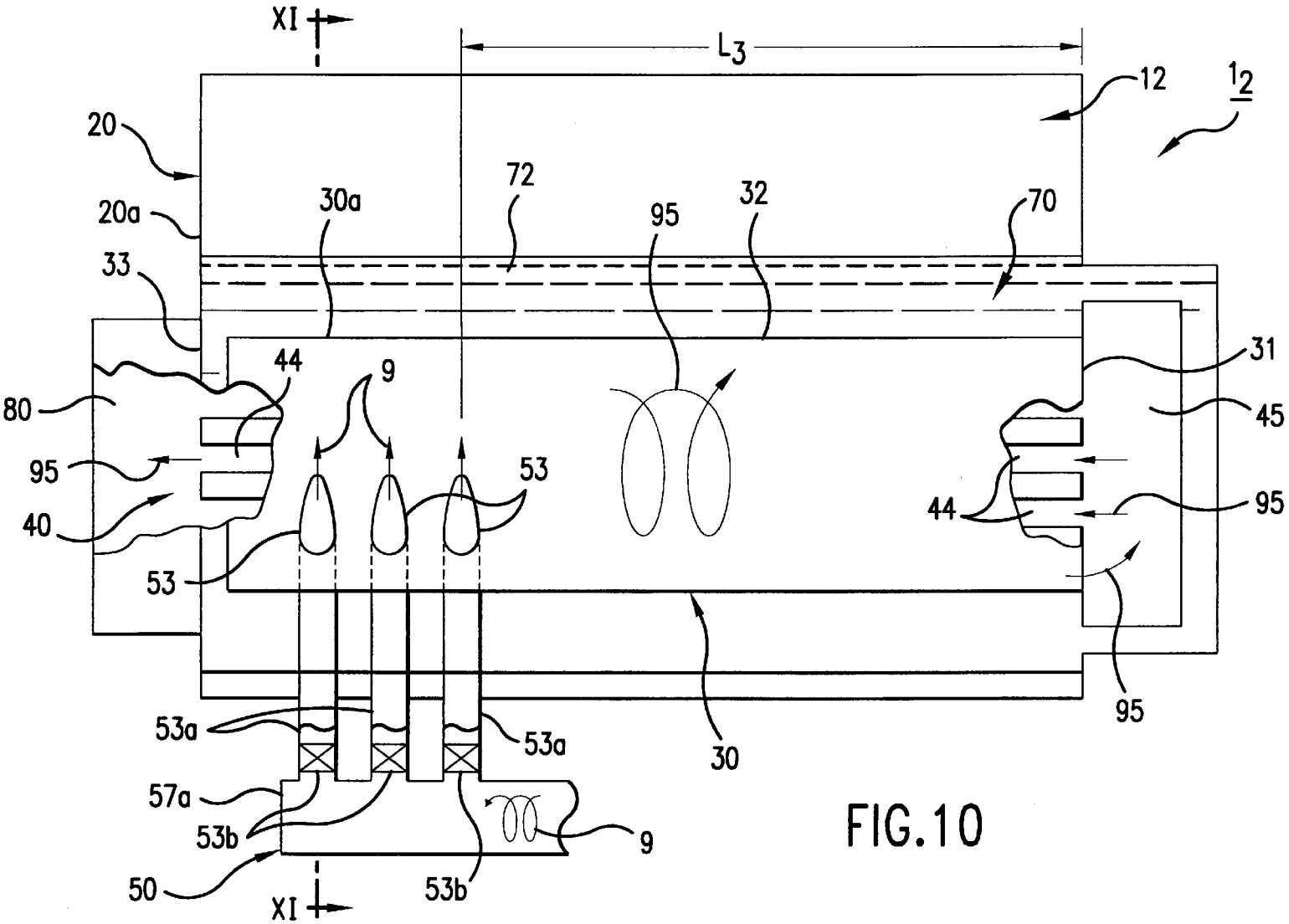
FIG. 10 is a vertical longitudinal section of a second combustion apparatus.

While the cooling of flames 93, 94 curbs the generation of nitrogen oxides, there may be concern that flames 93, 94 are unstable. This concern is unfounded. Flames 93, 94 are stable, because the flame 94 from auxiliary nozzle port 52 directly heats main nozzle port 51 and part of the flame 93 from main nozzle 51 heats auxiliary nozzle port 52, as described, and because the distance $L_1$ between the nozzles 51, 52 and the end wall 33 in the rear-front direction is provided as mentioned above so that a region for recirculation of combustion gas 95 may be formed on the front side. That is to say, flames 93, 94 are stabilized by the heating of nozzles 51, 52 with flames and by recirculation of combustion gas 95. In other examples as shown in FIG. 10 and subsequent drawings, it is established that the flames can be stabilized without recirculation of the combustion gas 95 if a plurality of nozzle ports 53 . . . are so arranged as to be mutually well heated by flames 96 . . . . As shown, the number and arrangement of nozzle ports can be freely selected within the scope of this invention such that a good cyclonic combustion and a stable flame are obtained.

In another example, the premixed gas 9 is jetted out of the respective nozzle ports 51, 52 at a high velocity in the direction tangential to the cylinder wall 32. Then, combustion gas 95 moves toward combustion gas outlet 31 in a swirl current along the inside cylindrical surface of combustion chamber 3, forming a so called cyclonic flame. Thus, a recirculation region is formed by the combustion gas 95 in the center of combustion chamber 3. This recirculation by combustion gas 95 inhibits the formation of nitrogen oxides. Experiments indicate that, although it depends on the combustion conditions and arrangements, including the construction of apparatus $\mathbf{1}_1$, the preferred jetting velocity of the premixed gas 9 should generally be not lower than 15 m/sec. if sufficient recirculation is to be caused to effect satisfactory cyclonic combustion.

Furthermore, the premixed gas 9 jetting out of the respective nozzle ports 51, 52 is a homogenous mixture of the gaseous fuel 91 and the combustion air 92, with a high degree of mixing as mentioned, and therefore burns evenly within combustion chamber 3 without creating local high temperature zones. This also helps to inhibit the generation of nitrogen oxides.

As illustrated, then, first combustion apparatus $\mathbf{1}_1$ can effect satisfactory cyclonic combustion while substantially reducing the generation of nitrogen oxides.

Figure 9:
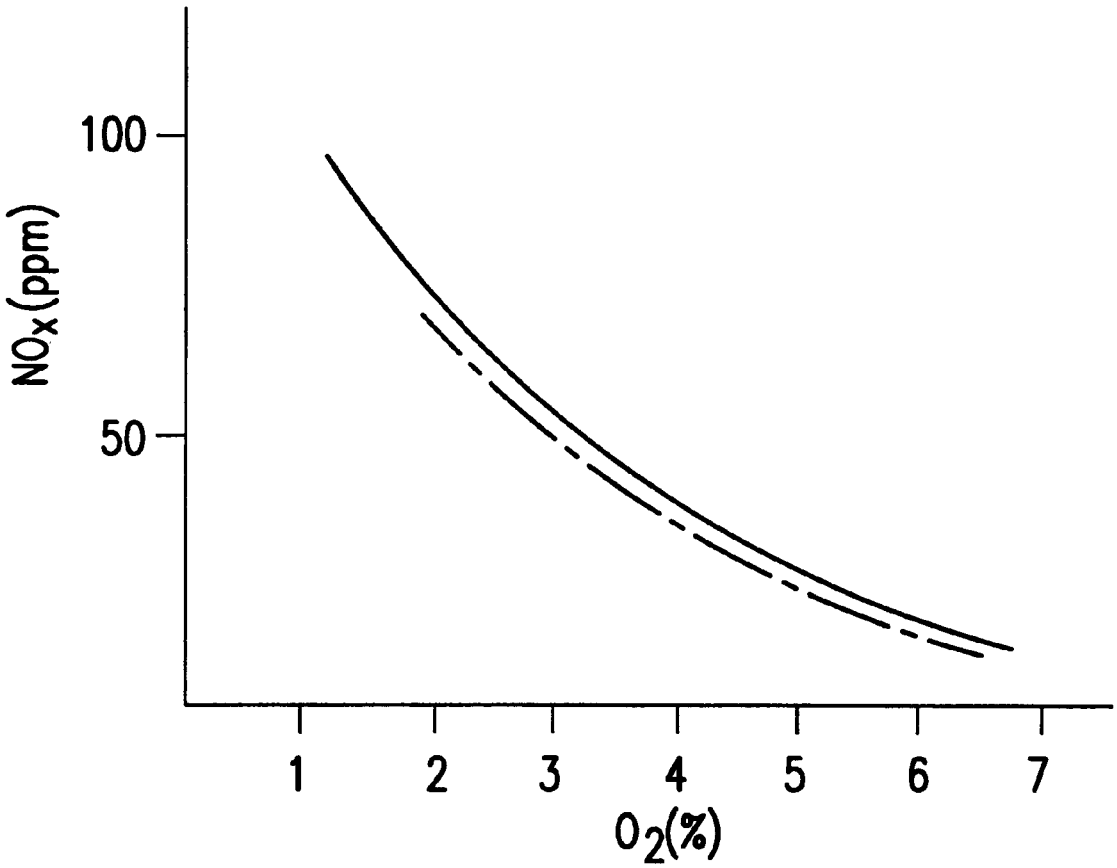
FIG. 9 is a graphical representation of combustion characteristics of the first combustion apparatus.

This has been confirmed in an experiment with first combustion apparatus $\mathbf{1}_1$. The experiment was carried out in accordance with procedures described above employing the following fuel and equipment under the conditions as specified:

gaseous fuel natural gas 13A jetting velocity of premixed gas 15 m/sec.

diameter (D) of combustion chamber 600 mm length ($L_1$+$L_2$) of combustion chamber 1200 mm main nozzle diameter ($d_1$) 116 mm auxiliary nozzle diameter ($d_2$) 60 mm With a rated combustion (140 $Nm^3$/h), measurements were taken of the concentrations (in ppm) of $NO_x$ and CO in relation to the concentration of $O_2$. The results were that the amount of CO generated was 0 ppm, both at a low output (quantity of combustion gas: 32–44 $Nm^3$/h) and at a high output (quantity of combustion gas: 123–155 $Nm^3$/h). The generation of $NO_x$ was very low, as shown in FIG. 9. In FIG. 9, the solid line indicates the concentration of $NO_x$ at the low output and the broken line indicates the concentration of $NO_x$ at the high output.

Example 2—Smoke Tube Boiler

FIGS. 10–13 show a second embodiment of the invention. The cyclonic type combustion apparatus $\mathbf{1}_2$ in this embodiment comprises a main casing 20, a combustion chamber 30, a heat exchanger 40, a premixed gas feeder 50, and an igniter 60. This second combustion apparatus is incorporated into a smoke tube boiler.

Figure 11:
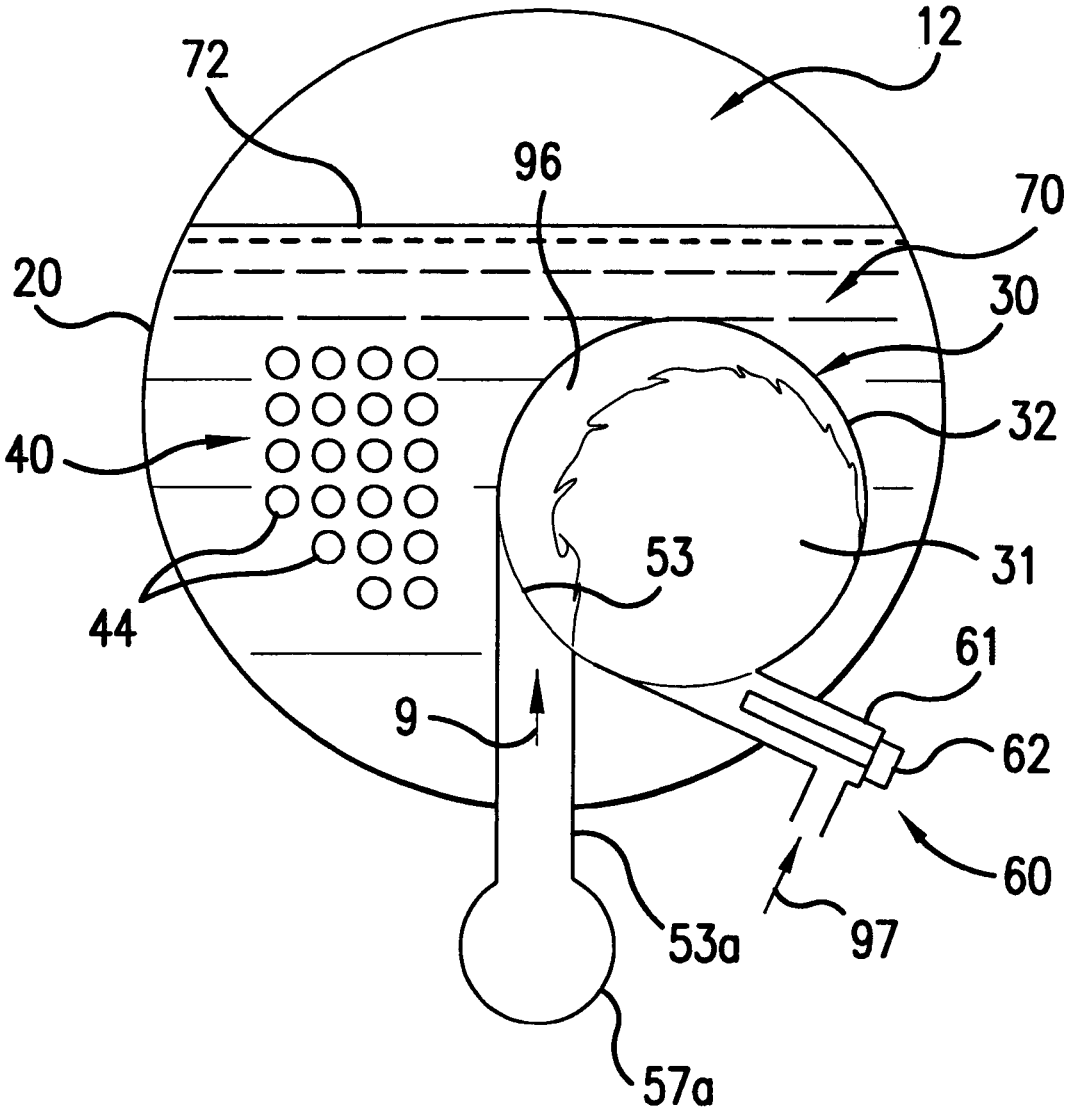
FIG. 11 is a cross-sectional side view of the second combustion apparatus, taken on line XI—XI of FIG. 10.

Main casing 20 is cylindrical in shape and of metal wall construction, as shown in FIGS. 10 and 11. A storage region 70 is formed for the medium to be heated, or boiler water 72. This storage region is referred to hereinafter as the boiler water storage region. The upper space in boiler water storage region 70 forms a steam generating region 12.

Combustion chamber 30 is made of metal plate and is of the same construction as combustion chamber 3 mentioned above. It has a cylinder wall 32 with the front end closed and with the rear end being combustion gas outlet 31. That is, combustion chamber 30 is positioned with its axial line horizontal and immersed in boiler water storage region 70. The cylinder wall 32 and the end wall 33 are made heat conductive, and are cooled in a heat exchange with the boiler water 72. On the inside cylindrical surface, or the inside surface of cylinder wall 32 at the front end section 30*a* of the combustion chamber, are disposed a plurality of nozzle ports 53 . . . which jet out premixed gas 9 in the direction tangential to the inside circumference along the in side cylindrical surface. The nozzle ports 53 are arranged in the axial direction of combustion chamber 30 and are not shifted in the circumferential direction of the combustion chamber, but take the same position in the circumferential direction, as will be described later.

The heat exchanger 40 is provided beside the combustion chamber 30 and comprises a group of smoke tubes 44 . . . extending in the front-rear direction immersed in boiler water storage region 70, as shown in FIGS. 10 and 11. The rear end portions of this group of smoke tubes 44 are communicated with the combustion gas outlet 31 by way of a communicating chamber 45 and the front end portions are communicated with a flue 80. Before it is discharged into the flue 80 after passing combustion gas outlet 31 and the group of smoke tubes 44, combustion gas 95 is subjected to heat exchange with the medium to be heater, or the boiler water 72.

Premixed gas feeder 50 supplies the premixed gas 9 to the premixed gas combustion section, or the combustion chamber 30. The premixed gas 9 is formed of a mixture of the gaseous fuel 91, for instance natural gas, and combustion air 92. As shown in FIGS. 10–13, feeder 50 comprises an air flow separating mechanism 54 to separate a specific flow rate of the combustion air 92 to form the premixed gas 9 into two portions—that is, the first portion of combustion air 92*a* and the second portion of combustion air 92*b*. Additionally, the gas feeder comprises a primary mixing mechanism 55 to mix the first portion of combustion air 92*a* and the gaseous fuel 91 with a specific flow rate to form premixed gas 9. The gas feeder also comprises a secondary mixing mechanism 56 for mixing the primary mixed gas $\mathbf{9}_1$ produced in the primary mixing mechanism 55 and the second portion of combustion air 92*b* which has passed through the air flow separating mechanism 54. The gas feeder comprises too a premixed gas producing mechanism 57 for further mixing and stirring a secondary mixed gas $\mathbf{9}_2$ produced in the secondary mixing mechanism 56 by imparting a swirling force. Finally, the gas feeder comprises a premixed gas feeding mechanism to feed the premixed gas 9 produced in the premixed gas producing mechanism to the premixed gas combustion section, or the combustion chamber 30.

The premixed gas feeding mechanism comprises a plurality of nozzles 53*a* . . . (in the example shown, 3 pieces) with the respective nozzle ports 53 open on the inside cylindrical surface of the combustion chamber 30. Nozzles 53*a* . . . are made of metal cylindrical pipe with identical round cross-sections. As shown in FIGS. 10 and 11, the nozzles 53 . . . are disposed side by side in close vicinity to each other in the axial direction of the combustion chamber and take the same position in the circumferential direction. These nozzles 53 are mounted on the cylinder wall 32 of the combustion chamber 30 and arranged in the vicinity of one another in the direction of the axial line thereof in such a way that the premixed gas 9 is jetted out of the nozzle ports 53 . . . in the direction tangential to the inside circumference of the combustion chamber 30. The jetting directions are identical in relation to the circumferential direction of the combustion chamber 30. Incidentally, in the first combustion chamber $\mathbf{1}_1$ the distance $L_1$ from the end wall 33 to the nozzle ports is made long enough to form a recirculation region of the combustion gas 95 in the forward portion of the chamber or forwardly of the position of the nozzle ports in order to stabilize the flames 93, 94. In the second combustion apparatus $\mathbf{1}_2$ a plurality of nozzle ports 53 . . . are disposed in close vicinity to each other and there is no need to give consideration to the rear-front distance between the end wall 33 and the groups of nozzle ports 53 . . . . That is to say, in the second combustion apparatus $\mathbf{1}_2$ the interval between the nozzle ports 53 . . . in the axial direction is set as narrow as possible so that the flame 96 of the premixed gas 9 jetted out of one nozzle port 53 heats another adjacent nozzle port 53. Heating the nozzle by the flame of the adjacent nozzle port 53 stabilizes the flames 96 even if the flames 96 are cooled and brought to a low temperature by the boiler water 72. It is noted that the distance $L_3$ between the most backward nozzle port 53 and the combustion gas outlet 31 is made the same as the corresponding distance $L_2$ in the first combustion apparatus $\mathbf{1}_1$ so as to enhance cyclonic combustion. Each nozzle 53*a* . . . is equipped with a flow regulator 53 (an orifice, for example) to impart uniformity to an amount of premixed gas as jetted from the respective nozzle ports 53 . . . . The jetting velocity of the gas at each nozzle port is preferably not lower than 15 m/sec. as in the first combustion apparatus $\mathbf{1}_1$.

Figure 13:
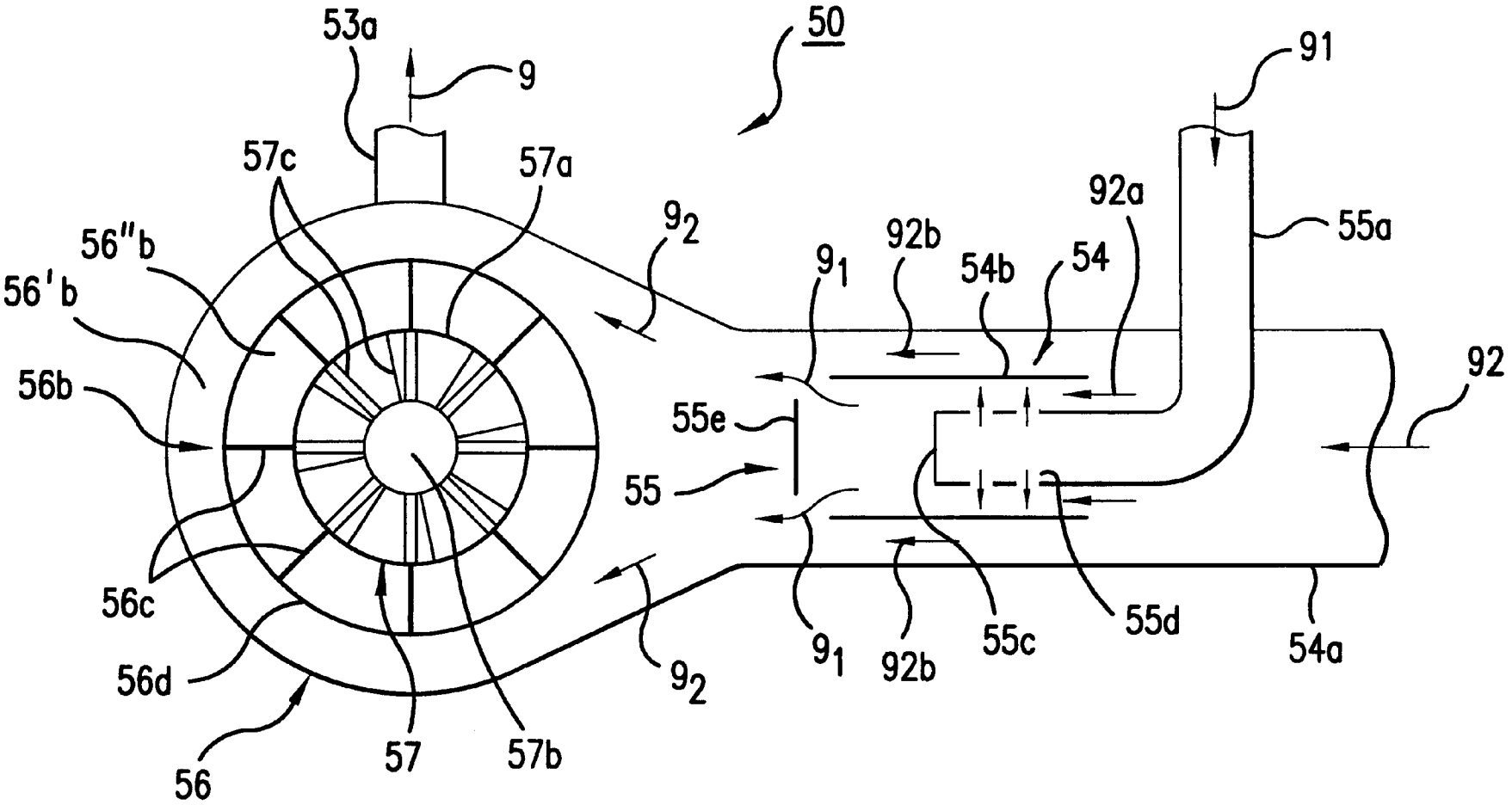
FIG. 13 is a cross-sectional view, taken on line XIII—XIII of FIG. 12.

The air flow separating mechanism 54 is identical in construction with the air flow separating mechanism in the first combustion apparatus $\mathbf{1}_1$. That is to say, an air flow separating cylinder 54*b* is provided concentrically in the downstream end portion of a combustion air feed tube 54*a* with a round cross-section which supplies the combustion air 92 to form a premixed gas 9 at a specific flow rate, as shown in FIG. 13. It is arranged so that combustion air that has reached the downstream end section of the combustion air feed tube 54*a* is separated into two portions, namely, the first portion of combustion air 92*a* which flows into the inside cylindrical region of the air flow separating cylinder 54*b* and the second portion of combustion air 92*b* which flows into the outside circumferential region thereof.

The primary mixing mechanism 55 is the same as the primary mixing mechanism in the first combustion apparatus, except that a baffle plate 55*e* is provided in place of the swirling vanes 55*b*, as shown in FIG. 13. That is, primary mixing mechanism 55 comprises a gaseous fuel feed tube 55*a* with a round cross-section to supply the gaseous fuel to form premixed gas 9 at a specific flow rate and a baffle plate 55*e* provided immediately in front of air flow separating tube 54*b*. Gaseous fuel feed tube 55*a* has its end section intruding into the air flow separating cylinder 54*b* through the wall of the combustion air feed tube 54*a* and has its end 55*c* closed. The end section of the gaseous fuel feed tube 55*a* is provided with a plurality of blowout holes 55*d* . . . arranged in the entire circumference of the tube so that the gaseous fuel 91 may blow out radially into the inside cylindrical space of the air flow separating cylinder 54*b*. Thus, the first portion of combustion air 92*a* and the gaseous fuel 91 blowing out of the blowout holes 55*d* . . . provided on the gaseous fuel feed tube 55*a* are mixed in the air flow separating tube 54*b*. Then, the mixed gas (or the primary mixed gas $\mathbf{9}_1$) thus obtained collides against the baffle plate 55*e* and, agitated, flows out through a circular opening between the air flow separating tube 54*b* and the baffle plate 55*e*. Instead of using the baffle plate 55*e*, it may be so arranged that the downstream end of the air flow separating tube 55*b* is closed, and holes for the primary mixed gas $\mathbf{9}_1$ to blow out will then be provided on the closed end.

Figure 12:
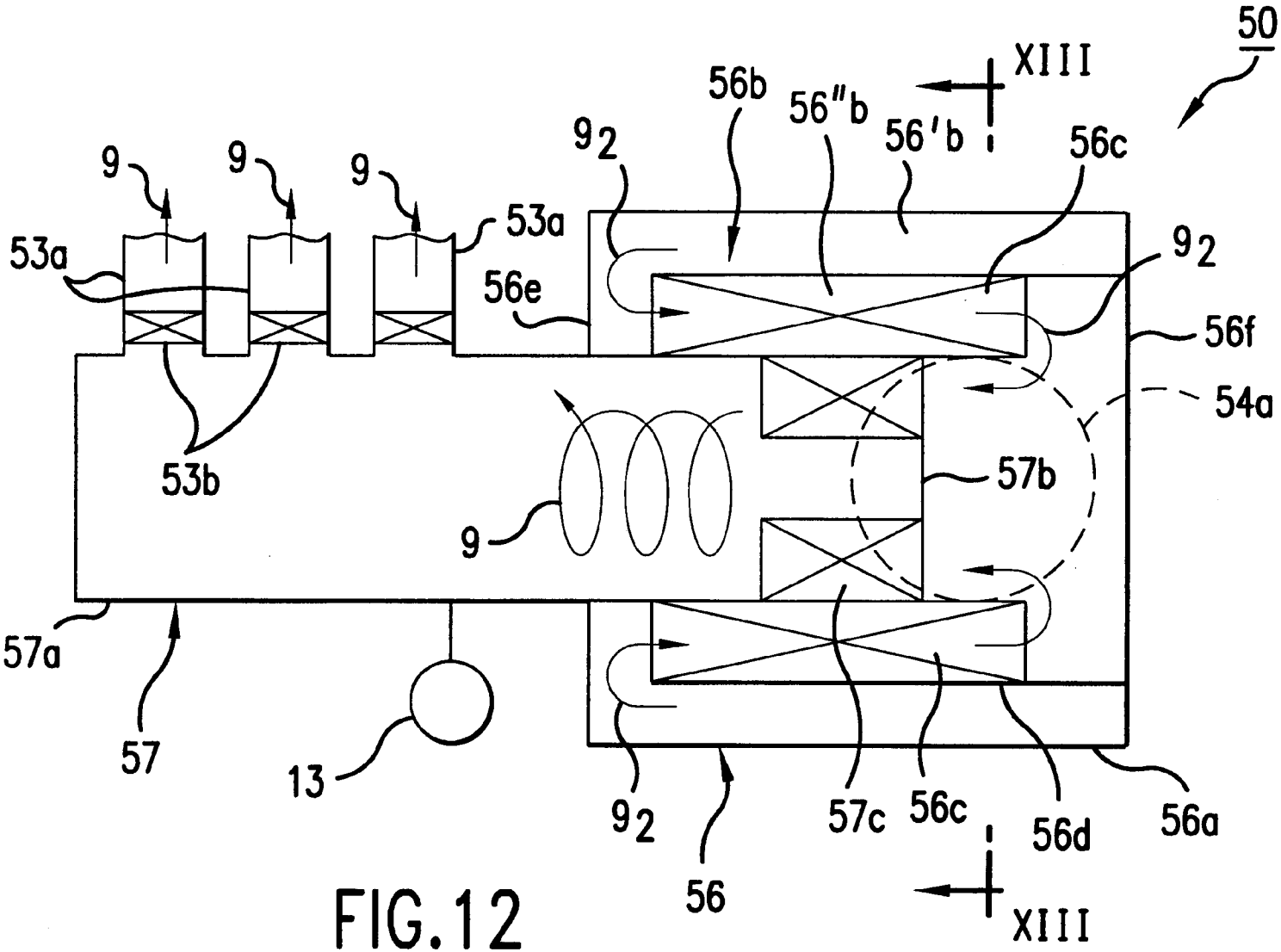
FIG. 12 is a vertical longitudinal sectional view of a main component (premixed gas feeder) of the second combustion apparatus.

Secondary mixing mechanism 56 is identical in construction to the secondary mixing mechanism in first combustion apparatus $\mathbf{1}_1$ except that secondary mixing tube 56*a* is connected to the downstream end of combustion air feed tube 54*a* with the axial line of the former orthogonal to that of the latter, as shown in FIGS. 12 and 13. Secondary mixing mechanism 56 comprises a secondary mixing cylinder 56*a* with a round cross-section, a zigzag secondary mixing passage 56*b* formed within secondary mixing cylinder 56*a*, and a plurality of current plates 56*c* . . . provided in the downstream end section of secondary mixing passage 56*b*. Secondary mixing cylinder 56*a* is larger than combustion air feed tube 54*a* in diameter. Secondary mixing cylinder 56*a* is connected orthogonally to the downstream end section of combustion air feed tube 54*a*, with its axial line parallel to the axial line of combustion chamber 30. Secondary mixing passage 56*b* comprises zigzag communicating concentric passage sections 56'*b*, 56"*b*, formed between secondary mixing cylinder 56*a* and an inner cylinder 56*d*, with a round cross-section concentrically arranged therein, and inside and outside the cylinder wall of premixed gas producing cylinder 57*a* with a round cross-section. In secondary mixing passage 56*b*, the primary mixed gas $\mathbf{9}_1$ flowing in a swirl current from the front end of air flow separating cylinder 54*b* and the second portion of combustion air 92*b* which has passed the outside circumferential region of air flow separating cylinder 54*b* meet and flow in a zigzag pattern, thereby producing a secondary mixed gas $\mathbf{9}_2$, which is a mixture of primary mixed gas $\mathbf{9}_1$ and the second portion of combustion air 92*b*. That is to say, the primary mixing gas $\mathbf{9}_1$ and the second portion of combustion air 92*b* first flow forward along a first cylindrical passage section 56'*b* formed between the secondary mixing cylinder 56*a* and an inner cylinder 56*d*, collide against a blocking plate 56*e*, make a turn, and proceed backward to a second cylindrical passage section 56"*b* formed between the inner cylinder 56*d* and the premixed gas producing cylinder 57*a*. Colliding against another blocking plate 56*f* of inner cylinder 56*d*, the gas and air turn and flow into the rear end of premixed gas producing cylinder 57*a*. During that process, primary mixing gas $\mathbf{9}_1$ and the second portion of combustion air 92*b* are mixed. The current plates 56*c* . . . are mounted radially between the inside cylindrical surface of inner cylinder 56*d* and the outer circumferential surface of premixed gas producing cylinder 57*a* in parallel with the axial direction and at regular intervals in the circumferential direction. The secondary mixed gas $\mathbf{9}_2$ is straightened by those plates while passing through second cylindrical passage section 56"*b* and flows into premixed gas producing cylinder 57*a* evenly from around the rear end edge.

The premixed gas producing mechanism 57, too, is identical in construction to the premixed gas producing mechanism 57 in first combustion apparatus 11, as shown in FIG. 12. The mechanism comprises a premixed gas producing cylinder 57*a* with a round cross-section connected to nozzles 53*a* . . . and a plurality of swirling vanes provided within premixed gas producing cylinder 57*a*. Premixed gas producing cylinder 57*a* has its rear end section intruding concentrically into inner cylinder 56*d* through the blocking plate 56*e* of the secondary mixing cylinder 56*a*. Premixed gas producing cylinder 57*a* has a bottom closed cylinder 57*b* provided concentrically in the rear end section and a plurality of swirling vanes 57*c* mounted radially between the two cylinders in regular circumferential intervals. Swirling vanes 57*c* . . . may be trapezoidal in shape, and are mounted at an inclined angle with respect to the axial line of the cylinders 57*a*, 57*b*. The angle of inclination is preferably 10 to 20, as with inclination β in first combustion apparatus $\mathbf{1}_1$. The angle is generally set at 15 degrees. The front end section of premixed gas producing cylinder 57*a* is protruded forward from secondary mixing cylinder 56*a*, with the cylinder wall communicating with the base section of nozzles 53*a* . . . . The front end of premixed gas producing cylinder 57*a* is closed. Therefore, in the premixed gas producing mechanism 57, the secondary mixed gas $\mathbf{9}_2$, flowing out from second cylindrical passage section 56"*b* (provided with current plates 56*c*) and entering the rear end section of premixed gas producing cylinder 57*a*, is given a swirling force by swirling vanes 57*c* and is mixed and agitated homogeneously into a premixed gas 9 of gaseous fuel 91 and combustion air 92. In this stage, secondary mixed gas $\mathbf{9}_2$ is straightened by current plates 56*c* . . . and flows into premixed gas producing cylinder 57*a* evenly in the circumferential direction. That ensures that a swirling force is imparted by swirling vanes 57*c* . . . , with even and effective mixing and agitation of secondary mixed gas 92 by the swirling. The premixed gas 9 thus produced flows forward in a swirling current from swirling vanes 57*c* . . . and jets out into combustion chamber 30 from each nozzle 53*a*.

Igniter 60 comprises an ignition nozzle 61 provided on cylinder wall 32 of combustion chamber 30 and a pilot burner 62 provide therein, as shown in FIG. 11. Ignition nozzle 61 is open on the inside cylindrical surface so that the combustion air 97 may be jetted out onto nozzle port 53. While jetting out combustion air 97 from ignition nozzle 61, this igniter 60 forms a pilot flame at pilot burner 62, igniting the premixed gas jetted out from nozzles 53*a* . . . . Once premixed gas 9 is ignited, the supply of combustion air 97 is stopped and pilot burner 62 is extinguished. Before pilot burner 62 is lighted, premixed gas feeder 50, combustion chamber 30, and the group of smoke tubes 44 are purged.

A so called cyclonic combustion takes place in combustion chamber 30 with this second combustion apparatus $\mathbf{1}_2$, with a low $NO_x$ combustion achieved, as with first combustion apparatus $\mathbf{1}_1$.

To illustrate, gaseous fuel 91 and combustion air 92 are homogeneously mixed into a premixed gas 9 with a high degree of mixing and are fed to nozzles 53*a* . . . by premixed gas feeder 50, as in the premixed gas feeder 5 described above. In this step, the premixed gas 9 obtained in premixed gas producing cylinder 57*a* is given a swirling force to such an extent that the constituent gas components will not be separated again. Therefore, premixed gas 9 is fed to nozzles 53*a* . . . with the high degree of mixing maintained, and thus premixed gas with a very high degree of mixing is jetted out of nozzle ports 53 . . . .

Ignited by pilot burner 62, the premixed gas jetted out from each nozzle port 53 forms an arc-shaped flame 96 along the inside cylindrical surface of combustion chamber 30, extending in contact with the inside cylindrical surface, as shown in FIG. 11. Each flame 96 is cooled by the boiler water 72, because the cylinder wall 32 of combustion chamber 30 is a heat conductive wall in contact with the boiler water 72. Since the premixed gas 9 is jetted out of each nozzle port 53 in the direction tangential to the inside circumference of cylinder wall 32 at a high velocity, the combustion gas 95 moves toward combustion gas outlet 31 in a current swirling along the inside cylindrical surface of combustion chamber 30, forming a so called cyclonic flame. Thus, a recirculation region is formed by combustion gas 95 backwardly of the group of nozzle ports 53 . . . or in the center of combustion chamber 30. Furthermore, the premixed gas 9 jetted out of each nozzle port 53 is a homogenous mixture of gaseous fuel 91 and combustion air 92, with a high degree of mixing, and burns evenly without forming local high temperature zones in combustion chamber 30. The cooling of flames 96 . . . , the recirculation of combustion gas 95, and the unification of combustion temperatures by the premixed gas 9 with a high degree of mixing, all work together to reduce substantially the generation of nitrogen oxides as well as carbon monoxide, as in first combustion apparatus $\mathbf{1}_1$. The heating of the nozzle ports by the flames 96 of the respective adjacent nozzle ports 53 stabilizes the respective flames 96, achieving a satisfactory cyclonic combustion in spite of the fact that flame 96 are cooled and brought to a low temperature.

Example 3—Hot Water Heater (Lateral Jetting)

Figure 14:
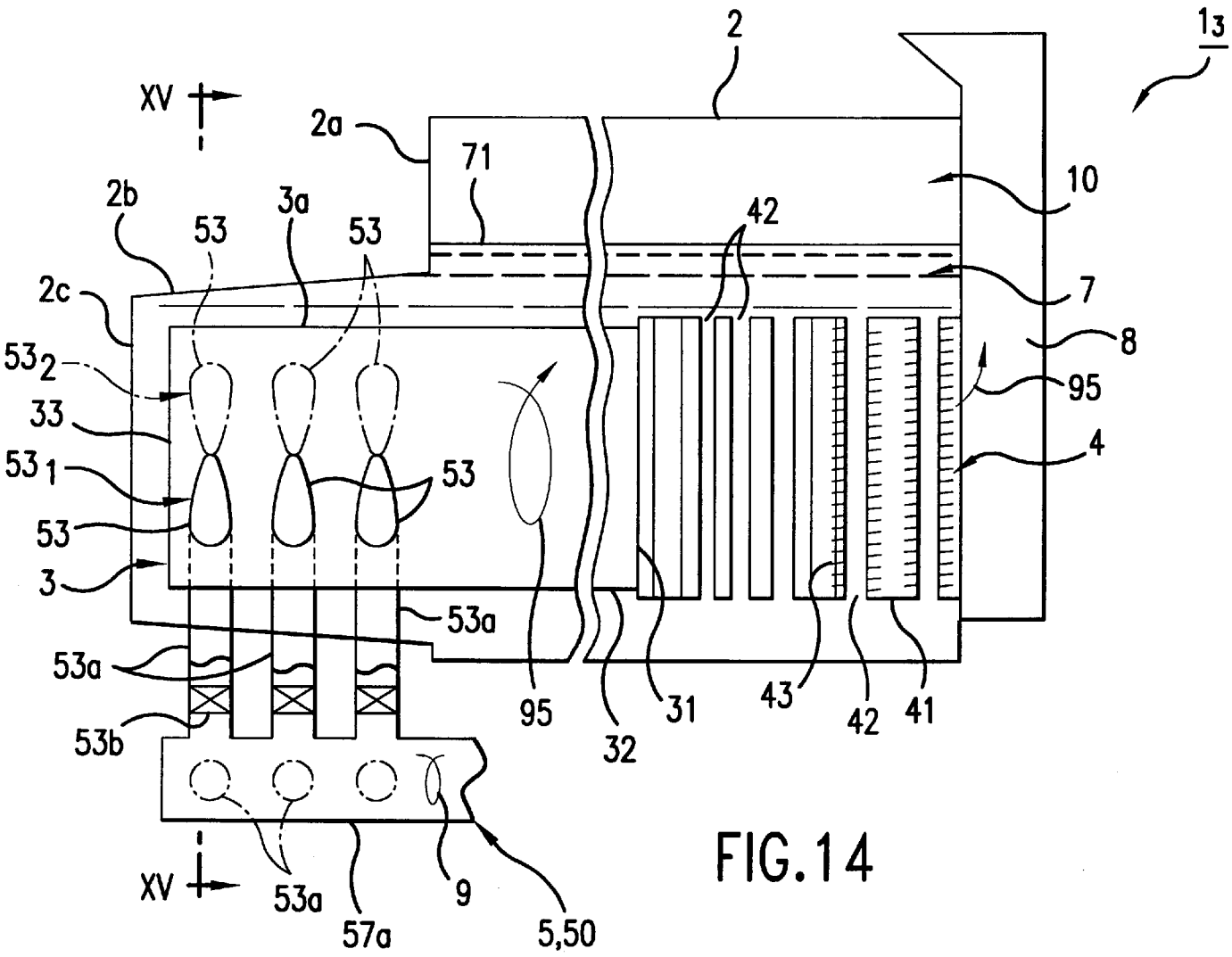
FIG. 14 is a vertical longitudinal section of a third combustion apparatus.
Figure 15:
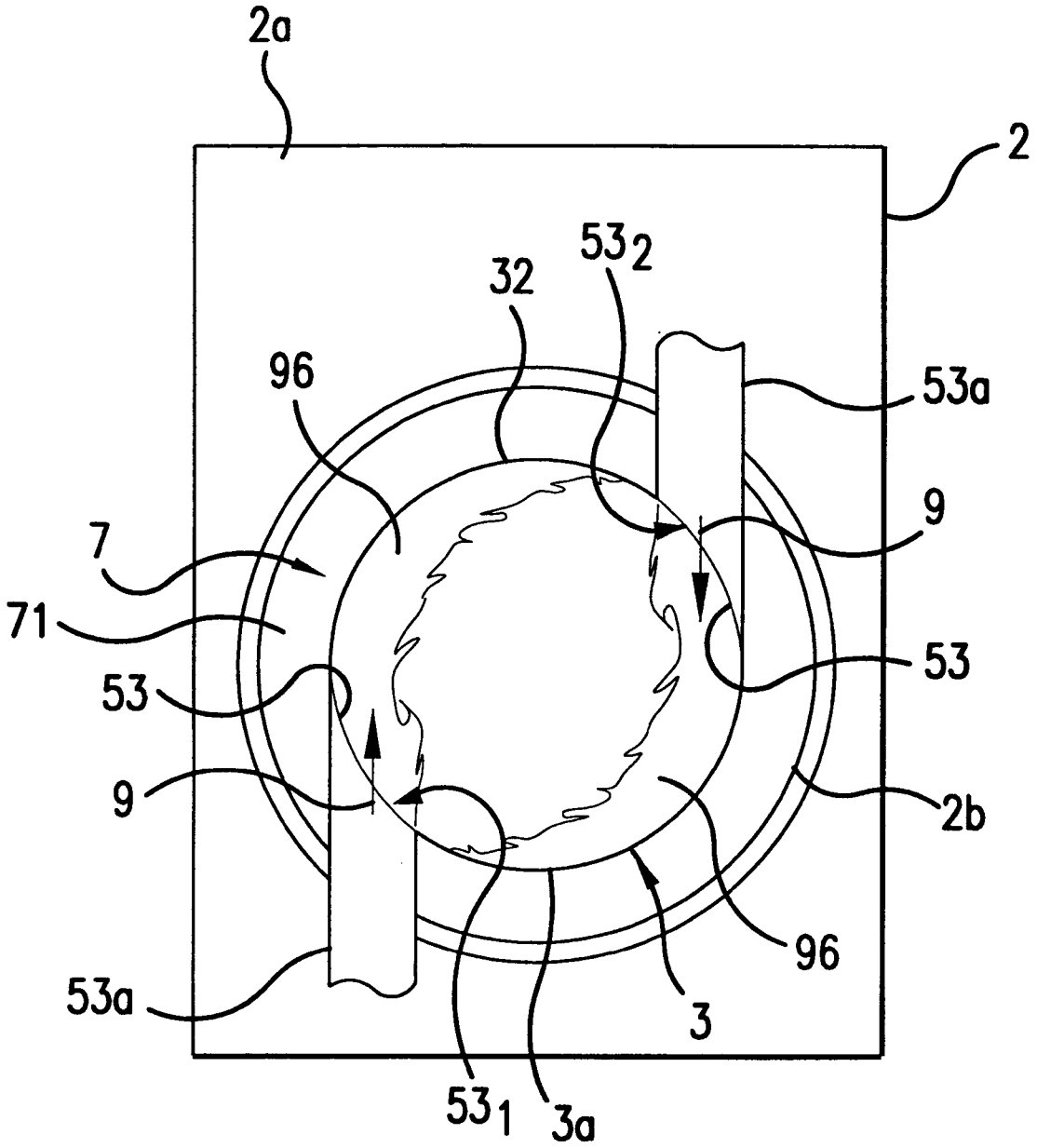
FIG. 15 is a vertical cross-sectional side view of the third combustion apparatus, taken on line XV—XV of FIG. 14.

FIGS. 14 and 15 show a third embodiment of the present invention. The cyclonic type combustion apparatus $\mathbf{1}_3$ (third combustion apparatus) in this embodiment is identical in construction to first combustion apparatus $\mathbf{1}_1$ except for the following features. Third combustion apparatus $\mathbf{1}_3$ has its front end section 3*a*, or the premixed gas jetting area of the combustion chamber, extending forwardly beyond front wall 2*a* of the main casing 2 and surrounded by projected section parts 2*b*, 2*c*, as shown in FIGS. 14 and 15. This design simplifies fabrication of the apparatus and eliminates adverse effects due to thermal stress generated between main casing 2 and combustion chamber 3. The projected section comprises a cylindrical part 2*b* that surrounds the front section of the cylinder wall 32 and a disk-shaped part 2*c* that closes the front end of cylindrical part 2*b* and faces end wall 33, and front section 3*a* of combustion chamber 3 is cooled with the heating medium water 71 filling between the front section 3*a* and the projected section parts 2*b*, 2*c*. The heating medium water 71 between the front section 3*a* and the projected section parts 2*b*, 2*c* circulates within main casing 2. A plurality of nozzles 53*a* . . . with the same cross-section as those in second combustion apparatus $\mathbf{1}_2$ are provided on the inside cylindrical surface of the cylinder wall of combustion chamber 3. Two groups $\mathbf{53}_1$, $\mathbf{53}_2$ of nozzle ports 53, the nozzle ports in each group disposed in close vicinity to each other side by side in the axial direction as in second combustion apparatus $\mathbf{1}_2$, are provided in such a way that they are not shifted but take the same position in the axial direction of the combustion chamber while they are spaced from each other at an interval of 180 degrees in the circumferential direction of the combustion chamber. From each group of nozzle ports, the premixed gas 9 is jetted out in the same quantity in the same direction tangential to the inside circumference of combustion chamber 3. Each nozzle 53*a* is communicated with the aforesaid premixed gas feeder 5 or the premixed gas producing cylinder 57*a* by way of a flow rate regulator 53b. In the third combustion chamber $\mathbf{1}_3$ as in the second combustion chamber $\mathbf{1}_2$, nozzle ports 53 are heated by the flames 96 from the respective nozzle ports 53 adjacent thereto in the axial direction of the combustion chamber. Depending on conditions such as, for instance, the inside diameter of the combustion chamber, the nozzle ports 53 are heated also by the flames from the respective nozzle ports adjacent thereto in the circumferential direction. Each flame 96 is stabilized by that mutual heating, which eliminates the need to provide a specific recirculation area at the front end section in contrast to the first combustion apparatus $\mathbf{1}_1$ in which there is provided the distance L between the premixed gas nozzle port and the end wall 33 long enough to create a recirculation to stabilize the flame. Needless to say, cyclonic combustion takes place just as in first and second combustion apparatuses $\mathbf{1}_1$ and $\mathbf{1}_2$.

Example 4—Hot Water Heater (Nozzle Port Spacing)

Figure 16:
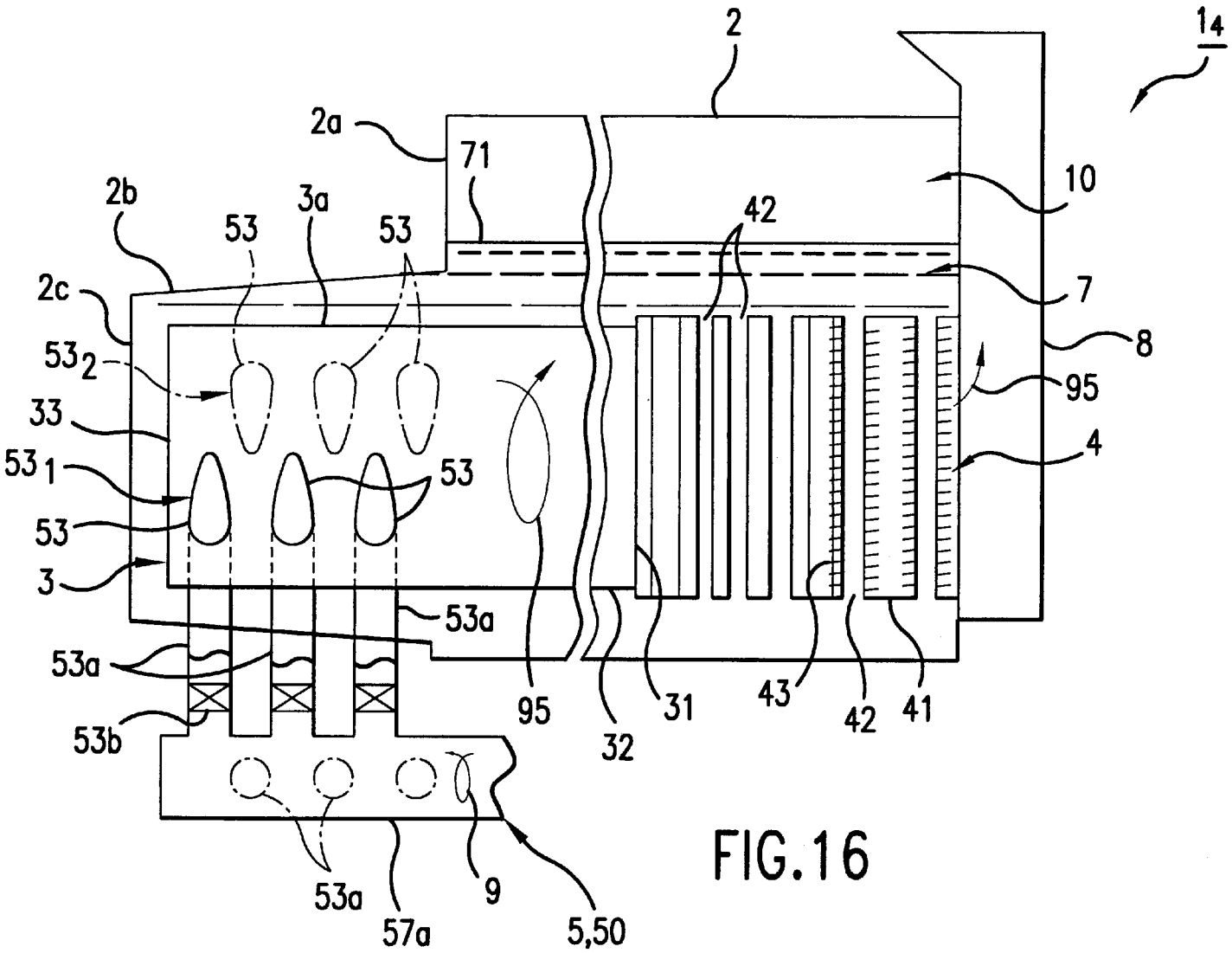
FIG. 16 is a vertical longitudinal section of a fourth combustion apparatus.

FIG. 16 shows a fourth embodiment of the present invention. The cyclonic type combustion apparatus in this embodiment, $1_4$, (fourth combustion apparatus) has two groups $53_1$, $53_2$ of nozzle ports 53. The nozzle ports in each group are disposed side by side in close vicinity to each other in the axial direction as in the third combustion apparatus $1_3$. But in the fourth combustion apparatus, the two groups of nozzle ports are provided in such a way as to take different positions in the axial direction of the combustion chamber and to be spaced from each other at an interval of 180 degrees in the circumferential direction of the combustion chamber. Except for that, the fourth combustion apparatus is identical to the third combustion apparatus in construction and combustion arrangements, including flame stabilization.

Example 5—Hot Water Heater (Inspection Hole)

Figure 17:
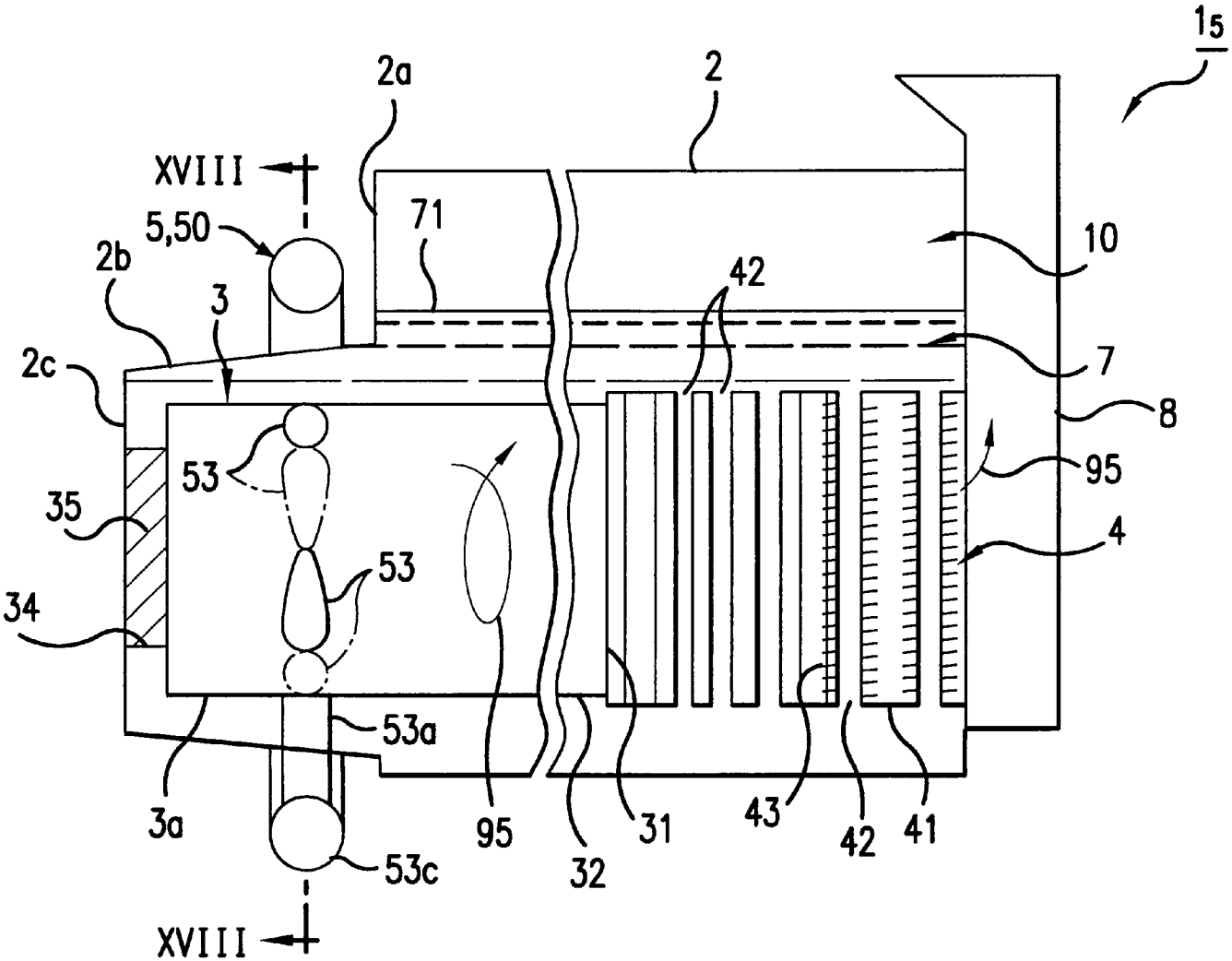
FIG. 17 is a vertical longitudinal section of a fifth combustion apparatus.
Figure 18:
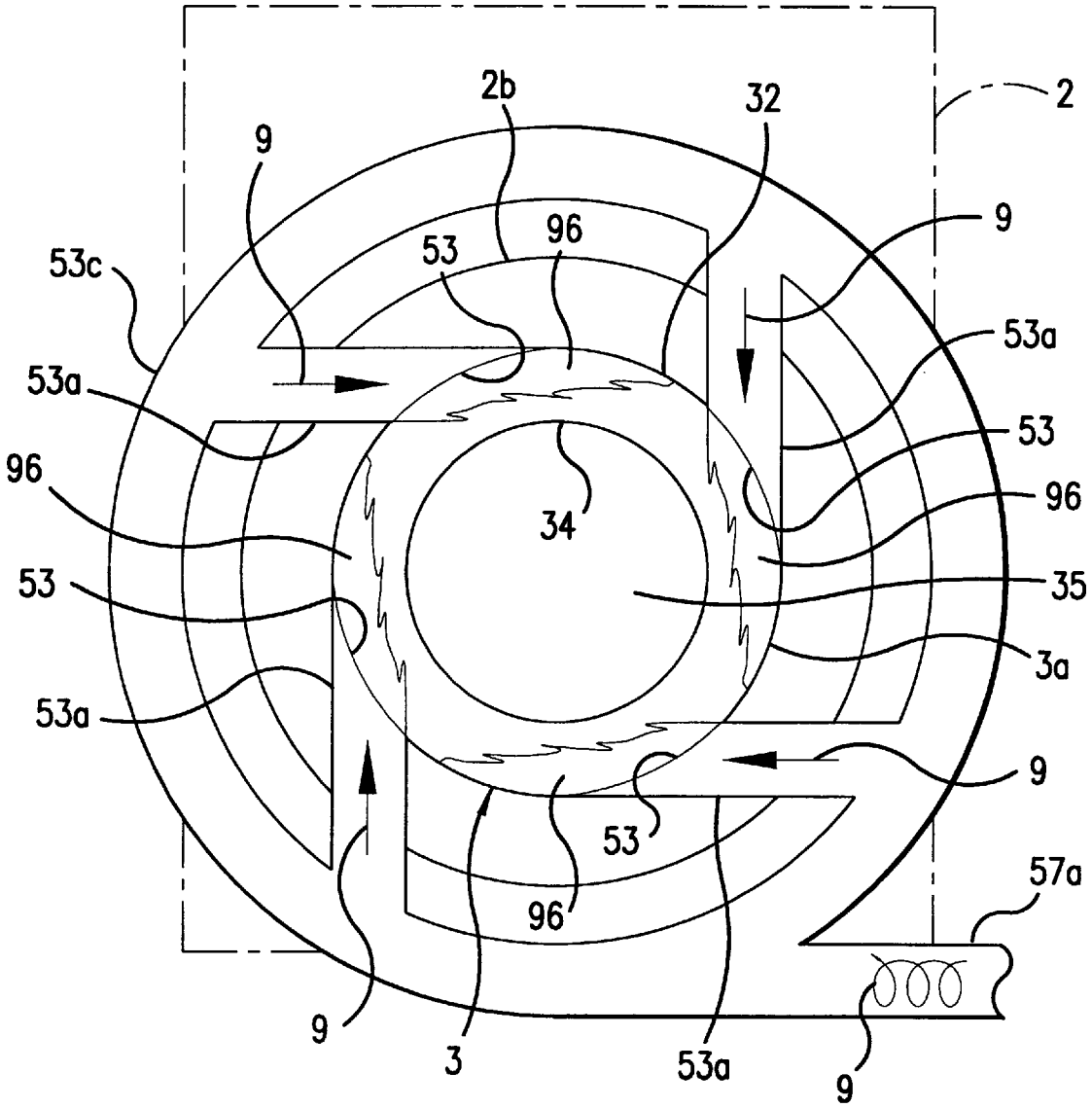
FIG. 18 is a cross-sectional side view of the fifth combustion apparatus, taken on line XVIII—XVIII of FIG. 17.

FIGS. 17 and 18 show a fifth embodiment of the present invention. The cyclonic type combustion apparatus $1_5$ in this embodiment (fifth combustion apparatus) is provided with a proper number of nozzle ports 53 . . . at regular intervals in the circumferential direction of the combustion chamber which are not shifted in the axial direction of the combustion chamber but take the same position in the axial direction. The number of nozzle ports 53 . . . and the interval between them in the circumferential direction of the combustion chamber are decided on in consideration of the inside diameter of the combustion chamber 3 and the amount of the premixed gas jetted out of each nozzle port 53 so that the flame of each nozzle port 53 heats another nozzle port 53 adjacent thereto in the jetting out direction. In the example shown, 4 nozzle ports 53 . . . are provided at an interval of 90 degrees in the circumferential direction of the combustion chamber. From those nozzle ports 53 . . . , the premixed gas 9 is jetted out in the same circumferential direction and in the direction tangential to the inside circumference of combustion chamber 3. The projected section (cylindrical part 2*b*) of the main casing 2 is provided with a circular header tube 53*c* with a round cross-section around it. Header tube 53*c* is communicated with the nozzles 53*a* and also with the premixed gas producing cylinder 57*a* of the aforesaid premixed gas feeder 5 or 50. Each nozzle 53*a* is provided with a flow rate regulator (not shown) such as an orifice, for example, to make uniform the amount of the premixed gas jetting from the respective nozzle ports 53 . . . . Furthermore, the fifth combustion apparatus $1_5$ is provided with an inspection hole 34 penetrating through the disk-shaped part 2*c* on the projected section of the main casing 2 and he end wall 33 of the combustion chamber 3. Inspection hole 34 is closed with a lid 35 of refractory material that can be removed to facilitate maintenance and inspection of combustion chamber 3. Except for those features, fifth combustion chamber $1_5$ is identical with fourth combustion apparatus $1_4$ in construction and combustion arrangements.

While preferred embodiments have been described, it is to be understood that the present invention is not limited to any of the details of description presented hereinabove. Changes and variations may be made without departing from the spirit and scope of the invention. For instance, the present invention is applicable not only to hot water heaters such as $1_1$, $1_3$, $1_4$, and $1_5$ and smoke tube boiler $1_2$ but also to combustion apparatuses of any form so long as their combustion chamber 3, 30 is cylindrical in shape and their cylinder walls 32 are heat conductive walls to be cooled by media to be heated, such as water 71, 72. Also, premixed gas jetting conditions such as the number and arrangement of nozzle ports 51, 52, 53 can be freely selected according to the combustion chamber dimension such as, for instance, inside diameter of the combustion chamber 3, 30 so long as the described cyclonic combustion and flame stabilization are ensured. Especially in first combustion apparatus $1_1$ provided with the auxiliary nozzle port 52 to work as igniter as well as the main nozzle port 51, it is possible to so design that with some igniting means, the cyclonic combustion is effected with one nozzle port 51 alone without providing an auxiliary nozzle port 52. In this case, the flame 93 is stabilized by recirculation of the combustion gas which takes place in a region near the nozzle port 5. The ignition means is not limited to the igniter 6 used in first and second combustion apparatuses $1_1$ and $1_2$. Instead, anything that can ignite the premixed gas jetting out of the nozzle port will do and can be freely designed.

As is evident from the foregoing description, the cyclonic type combustion apparatus of the present invention can effect a stable cyclonic combustion while substantially reducing the generation of nitrogen oxides and is, therefore, of high practical value. That is, the present invention provides cyclonic type combustion apparatus that can readily be implemented in practice.

What is claimed is:

1. A cyclonic combustion apparatus for heating water, said apparatus comprising a cylindrical combustion chamber with at least one nozzle port open on an inside wall surface of said cylindrical combustion chamber, through which nozzle a premixed gas made by mixing a gaseous fuel and air for combustion are jetted out in a direction tangential to an inside circumference along an inner cylindrical surface of said cylindrical combustion chamber, a storage region for the water to be heated surrounding a peripheral wall of said cylindrical combustion chamber, and a flue from a combustion gas outlet passing between heat-conductive water pipes opened to said storage region, said flue being arranged so that combusted gas is discharged thereinto, wherein said peripheral wall of said cylindrical combustion chamber is a heat-conductive wall that is in contact with the water to be heated so that the temperature of a flame formed by combustion of the premixed gas jetting out from the nozzle port is lowered by a conduction of heat through the peripheral wall into the water.

2. The cyclonic combustion apparatus of claim 1, wherein said cylindrical combustion chamber is closed at an end part and open at another end part to form a combustion gas outlet, and is immersed in the water to be heated in said storage region with its axial line being horizontal.

3. The cyclonic combustion apparatus of claim 1, wherein said at least one nozzle port is a plurality of nozzle ports.

4. The cyclonic combustion apparatus of claim 3, wherein said plurality of nozzle ports are arranged in a circumferential direction of said cylindrical combustion chamber and are not shifted in the axial line direction thereof but take the same position in the axial direction.

5. The cyclonic combustion apparatus of claim 4, wherein the flame formed by combustion of the premixed gas jetting out from each nozzle port heats another nozzle port adjacent thereto in the direction in which the premixed gas is jetted out.

6. The cyclonic combustion apparatus of claim 3, wherein said plurality of nozzle ports are arranged in the vicinity of one another in a direction of the axial line of said cylindrical combustion chamber and are not shifted but take the same position in the circumferential direction thereof, and wherein the flame formed by combustion of the premixed gas jetting out from each nozzle port heats the nozzle port adjacent thereto.

* * * * *